US011670258B2

(12) United States Patent
Kwon et al.

(10) Patent No.: US 11,670,258 B2
(45) Date of Patent: Jun. 6, 2023

(54) METHOD OF LUMINANCE COMPENSATION, LUMINANCE COMPENSATION SYSTEM AND DISPLAY SYSTEM

(71) Applicant: SAMSUNG ELECTRONICS CO., LTD., Suwon-si (KR)

(72) Inventors: Hongki Kwon, Seongnam-si (KR); Taewoo Kim, Hwaseong-si (KR); Jinyong Park, Hwaseong-si (KR); Hyunwook Lim, Seoul (KR); Woohyuk Jang, Hwaseong-si (KR); Hojun Chung, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 181 days.

(21) Appl. No.: 17/155,487

(22) Filed: Jan. 22, 2021

(65) Prior Publication Data

US 2022/0036857 A1 Feb. 3, 2022

(30) Foreign Application Priority Data

Jul. 28, 2020 (KR) ..... 10-2020-0093654

(51) Int. Cl.
*G09G 5/10* (2006.01)
*G09G 3/20* (2006.01)

(52) U.S. Cl.
CPC ..... *G09G 5/10* (2013.01); *G09G 3/20* (2013.01); *G09G 2320/0233* (2013.01); (Continued)

(58) Field of Classification Search
CPC .... G09G 5/10; G09G 3/20; G09G 2320/0233; G09G 2320/0626; G09G 2320/0693; G09G 2330/08; G09G 2360/145
See application file for complete search history.

(56) References Cited

U.S. PATENT DOCUMENTS 8,610,654 B2 * 12/2013 Kerofsky ..... G09G 3/3611 345/3.4
8,836,879 B2 9/2014 Ge et al.
(Continued)

FOREIGN PATENT DOCUMENTS

| | | | |
|---|---|---|---|
| CN | 201610796108 | A | 1/2017 |
| KR | 1552992 | A | 6/2011 |
| KR | 1611919 | A | 7/2011 |

*Primary Examiner* — Amare Mengistu
*Assistant Examiner* — Jennifer L Zubajlo
(74) *Attorney, Agent, or Firm* — Volentine, Whitt & Francos, PLLC

(57) ABSTRACT

A method of luminance compensation includes; generating luminance compensation data based on test image data, each of the test image data corresponding to one gray level, and each of the luminance compensation data including compensation values corresponding to the one gray level, generating intra-plane data based on the luminance compensation data, one of the intra-plane data being generated based on one of the luminance compensation data, generating inter-plane stream data based on the intra-plane data, one of the inter-plane stream data being generated based on data blocks included in the intra-plane data and disposed at a same location within the intra-plane data, and sequentially storing the inter-plane stream data in a memory.

20 Claims, 18 Drawing Sheets

(52) U.S. Cl.
CPC ..... *G09G 2320/0626* (2013.01); *G09G 2320/0693* (2013.01); *G09G 2330/08* (2013.01); *G09G 2360/145* (2013.01)

(56) References Cited

U.S. PATENT DOCUMENTS

| | | | | |
|---|---|---|---|---|
| 9,357,209 | B2 | 5/2016 | Kim et al. | |
| 9,799,257 | B2 * | 10/2017 | Tian | G09G 3/3225 |
| 10,224,955 | B2 * | 3/2019 | Tao | H03M 7/3062 |
| 2010/0013751 | A1 * | 1/2010 | Kerofsky | G09G 3/3611 345/89 |
| 2014/0028859 | A1 * | 1/2014 | Kim | G09G 3/30 348/189 |
| 2015/0348458 | A1 * | 12/2015 | Tian | G09G 3/3225 345/77 |
| 2016/0163274 | A1 | 6/2016 | Moon et al. | |
| 2016/0217724 | A1 * | 7/2016 | Kim | G09G 5/395 |
| 2020/0013326 | A1 * | 1/2020 | Zheng | G09G 3/20 |
| 2020/0211502 | A1 * | 7/2020 | Kim | G09G 3/006 |
| 2021/0304673 | A1 * | 9/2021 | Gao | G09G 3/3233 |
| 2021/0335327 | A1 * | 10/2021 | Li | G09G 5/391 |
| 2022/0148528 | A1 * | 5/2022 | Ooga | G09G 3/3426 |
| 2022/0208067 | A1 * | 6/2022 | Heo | G09G 3/2074 |

* cited by examiner

METHOD OF LUMINANCE COMPENSATION, LUMINANCE COMPENSATION SYSTEM AND DISPLAY SYSTEM

CROSS-REFERENCE TO RELATED APPLICATION

This U.S. non-provisional application claims priority under 35 USC § 119 to Korean Patent Application No. 10-2020-0093654 filed on Jul. 28, 2020 in the Korean Intellectual Property Office (KIPO), the subject matter of which is hereby incorporated by reference.

BACKGROUND

1. Technical Field

Embodiments of the inventive concept relate generally to semiconductor integrated circuits, and more particularly to methods of compensating luminance, luminance compensation systems and display systems performing luminance compensation.

2. Discussion of the Related Art

Display devices—such as liquid crystal displays (LCD), plasma display panels (PDP) and organic light emitting displays (OLED)—are common used in many types of electronic devices. Various types of display panels, including many pixels, may be included in a display device. Pixels should exhibit a similar brightness (or the same luminance) in response to the same input data (e.g., a same gray level). However, defects in the design or variations in manufacturing process(es) of the display panel may cause a luminance deviation between pixels. Accordingly, luminance compensation should be performed.

SUMMARY

Various embodiments of the inventive concept provide methods of luminance compensation, luminance compensation systems and related display systems capable of reducing hardware cost and complexity associated with the reading of luminance compensation data.

In one embodiment, the inventive concept provides a method of luminance compensation including; generating luminance compensation data based on test image data, each of the test image data corresponding to one gray level, and each of the luminance compensation data including compensation values corresponding to the one gray level, generating intra-plane data based on the luminance compensation data, one of the intra-plane data being generated based on one of the luminance compensation data, generating inter-plane stream data based on the intra-plane data, one of the inter-plane stream data being generated based on data blocks included in the intra-plane data and disposed at a same location within the intra-plane data and sequentially storing the inter-plane stream data in a memory.

In another embodiment, the inventive concept provides a luminance compensation system including; a circuit configured to provide test image data to a display panel, wherein each of the test image data correspond to one gray level, an image capture device configured to generate luminance data by capturing a panel image displayed on the display panel in response to test image data and a luminance compensation circuit. The luminance compensation circuit may be configured to generate luminance compensation data based on the luminance data, wherein each of the luminance compensation data includes compensation values corresponding to the one gray level, generate intra-plane data based on the luminance compensation data, generate one of inter-plane stream data based on data blocks included in the intra-plane data and disposed at a same location within each of the intra-plane data, and sequentially store the inter-plane stream data in a memory.

In another embodiment, the inventive concept provides a display system including; a display device including a luminance compensation circuit and a host processor configured to control the display device. The luminance compensation circuit may include; a luminance compensation data memory configured to store inter-plane stream data, an intra-plane data generator configured to sequentially read the inter-plane stream data and generate data blocks based on the inter-plane stream data to generate intra-plane data, wherein the data blocks are included in the intra-plane data and are disposed at a same location within each of the intra-plane data, a luminance compensation data generator configured to generate luminance compensation data based on the intra-plane data, and a luminance compensation image data generator configured to generate output image data by compensating input image data based on the luminance compensation data.

BRIEF DESCRIPTION OF THE DRAWINGS

Example embodiments of the present disclosure will be more clearly understood from the following detailed description taken in conjunction with the accompanying drawings.

DETAILED DESCRIPTION

Certain embodiments of the inventive concept will be described in some additional detail with reference to the accompanying drawings. Throughout the written description and drawings, like reference numbers denote like or similar elements.

Figure (FIG.) 1 is a flowchart summarizing a method of luminance compensation according to embodiments of the inventive concept.

In this method, luminance compensation data are generated based on test image data (S1000). Here, each of the test image data may correspond to one gray level, and each of the luminance compensation data may include compensation values corresponding to the one gray level.

Intra-plane data are generated based on the luminance compensation data (S2000). Here, each of the intra-plane data may be generated based on one of the luminance compensation data.

Inter-plane stream data are generated based on the plurality of intra-plane data (S3000. Here, each of the inter-plane stream data may be generated based on data blocks included in the intra-plane data and disposed at a same location within the intra-plane data.

Once the inter-plane stream data has been sequentially stored in memory (S4000), it may be sequentially read from memory (S5000), as needed.

The intra-plane data may be generated by generating the data blocks based on the inter-plane stream data (S6000). The data blocks are included in each of the intra-plane data and are disposed at a same location within the intra-plane data.

Luminance compensation data are generated based on the intra-plane data (S7000), and output image data for displaying an image are generated by compensating input image data based on the luminance compensation data (S8000).

Figure 1:
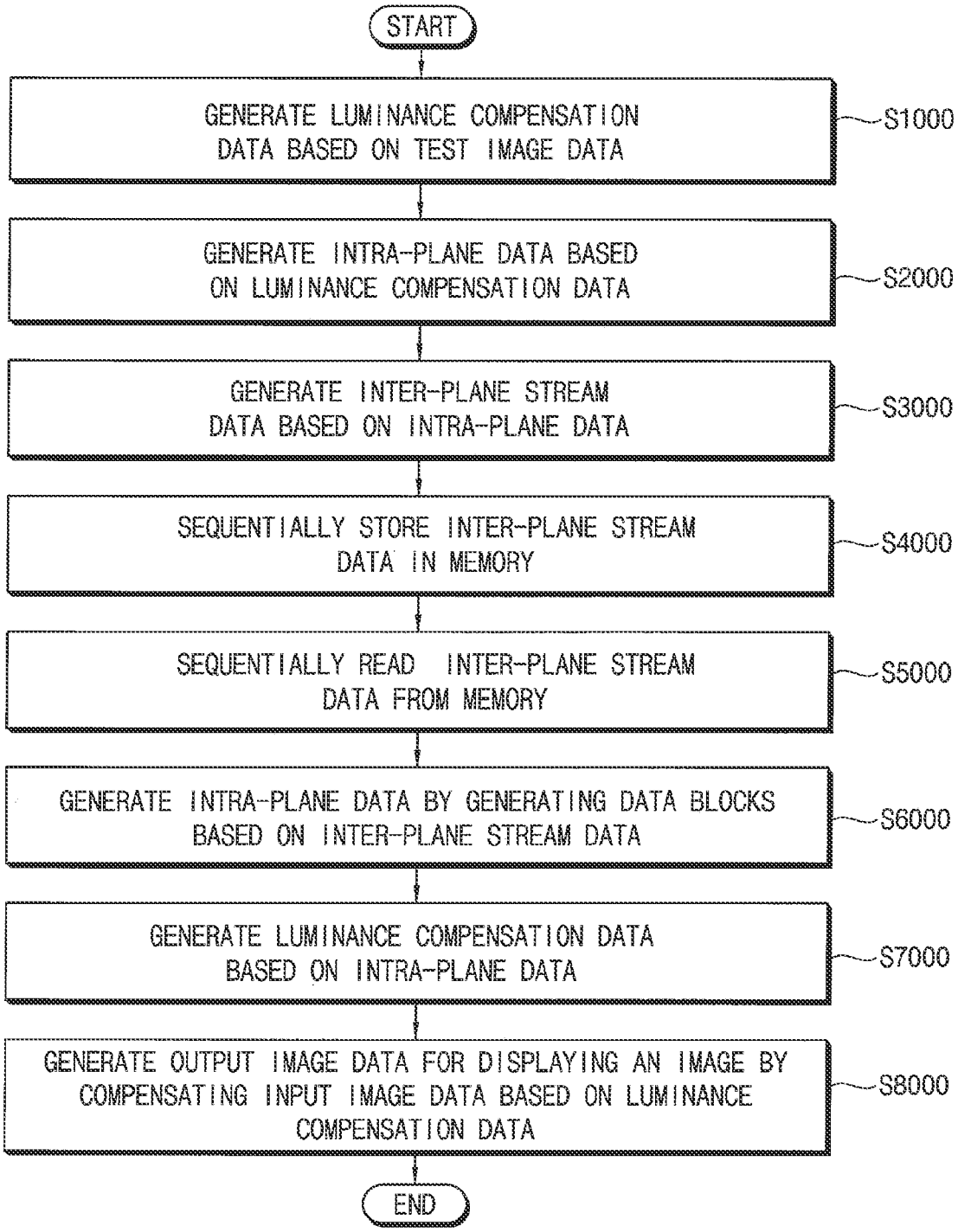
FIG. 1 is a flowchart summarizing a method of luminance compensation according to embodiments of the inventive concept.

In some embodiments, the method steps S1000, S2000, S3000 and S4000 of FIG. 1 may be performed using a first luminance compensation system 100—an example of which will be described later with reference to FIG. 2. The method steps S5000, S6000, S7000 and S8000 may be performed using a second luminance compensation system 200—an example of which will be described with reference to FIG. 8.

Figure 2:
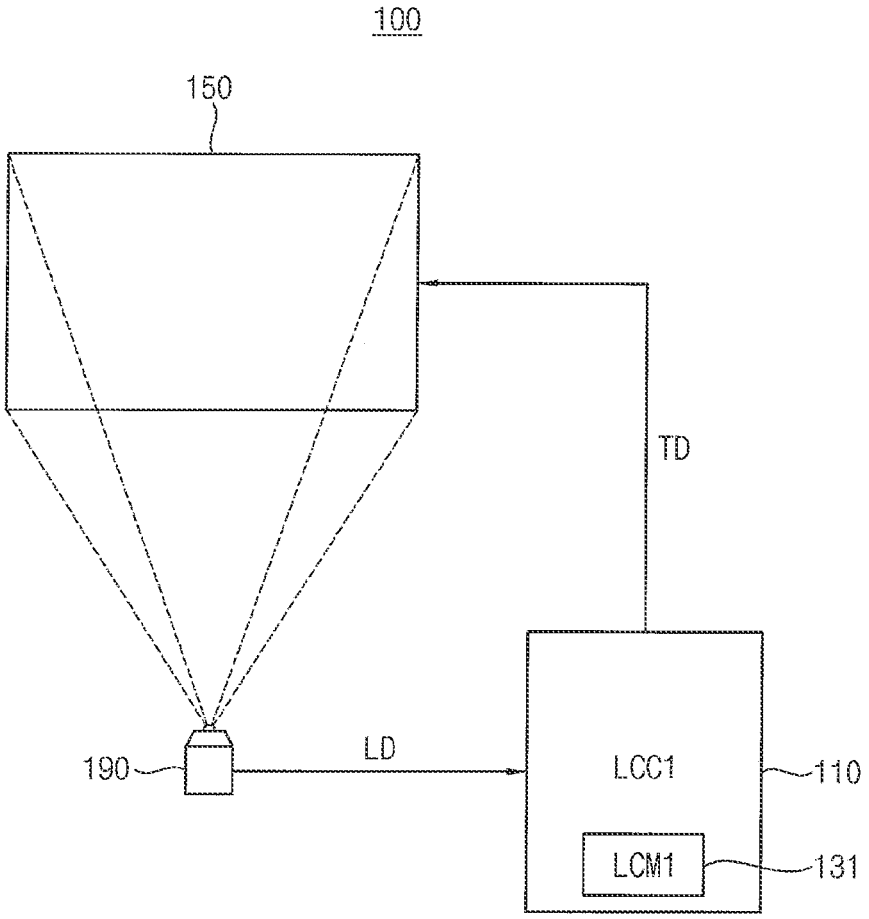
FIG. 2 is a conceptual diagram illustrating a first luminance compensation system according to embodiments of the inventive concept.

FIG. 2 is a block diagram illustrating in one example a first luminance compensation system according to embodiments of the inventive concept.

Referring to FIG. 2, the first luminance compensation system 100 may be used to generate luminance compensation data for a manufactured display panel. In this regard, the luminance compensation data may be used compensate for defects in the design and/or manufacture of the display panel before the display panel is incorporated into (or configured as) a display device. For example, when a display panel manufacturer is different from the manufacturer of a display device incorporating the display panel, the luminance compensation data may be generated by the display device manufacturer and thereafter communicated to the display device manufacturer.

Figure 8:
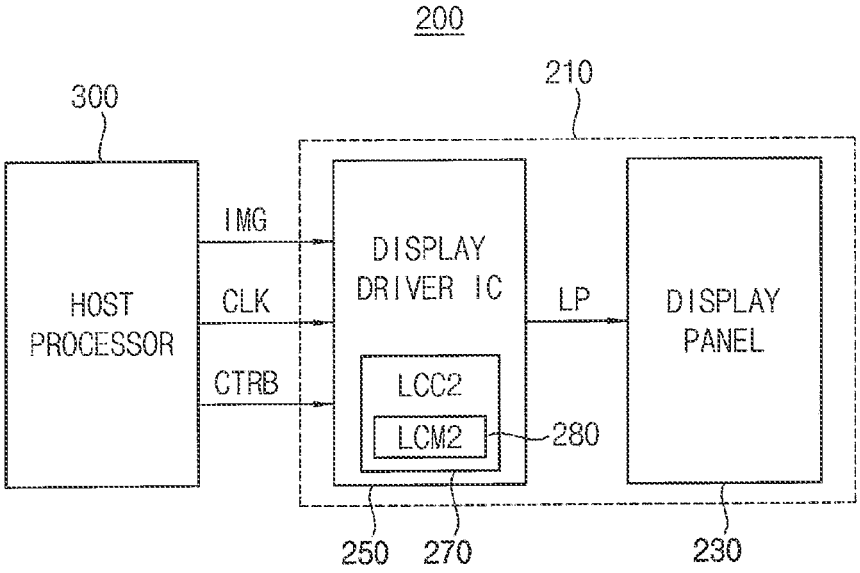
FIG. 8 is a block diagram illustrating a second luminance compensation system according to embodiments of the inventive concept.

The luminance compensation data may be transferred to and stored in a second luminance system 200, like the one described in relation to FIG. 8, and may thereafter be used to compensate input image data received by the second luminance compensation system 200. Thus, the first luminance compensation system 100 of FIG. 2 may be used to generate luminance compensation data associated with a display panel, and the second luminance compensation system 200 of FIG. 8 may thereafter use the luminance compensation data to compensate input image data received by a display device incorporating the display panel.

The first luminance compensation system 100 of FIG. 2 may include a circuit configured to provide test image data to a display panel 150, wherein each of the test image data correspond to one gray level, a first luminance compensation circuit (LCC1) 110, and an image capture (e.g., photographing) device 190. In some embodiments, the circuit providing the test image data may be provide in the first luminance compensation circuit 110, such that the first luminance compensation circuit 110 may provide test image data TD to the display panel 150.

In some embodiments, the test image data TD may correspond to one gray level. For example, the test image data TD may respectively correspond to K gray levels, where 'K' is an integer greater than 1. Thus, the test image data TD may be respectively generated according to one of a first gray level, a second gray level, a third gray level and a fourth gray level (hereafter, "first to fourth gray levels"), wherein the first to fourth gray levels may respectively be (e.g.,) 31, 63, 127 and 255, but the scope of the inventive concept is not limited thereto.

The display panel 150 may display a panel image based on the test image data TD, and the image capture (e.g., photographing) device 190 may capture (e.g., photograph) the panel image and generate corresponding luminance data LD.

The first luminance compensation circuit 110 generates luminance compensation data based on the luminance data LD. For example, the first luminance compensation circuit 110 may generate intra-plane data based on the luminance compensation data, and generate inter-plane stream data based on the intra-plane data. In this regard, the first luminance compensation circuit 110 may store the inter-plane stream data in a first luminance compensation data memory (LCM1). This approach will be described hereafter in some additional detail.

Figure 3:
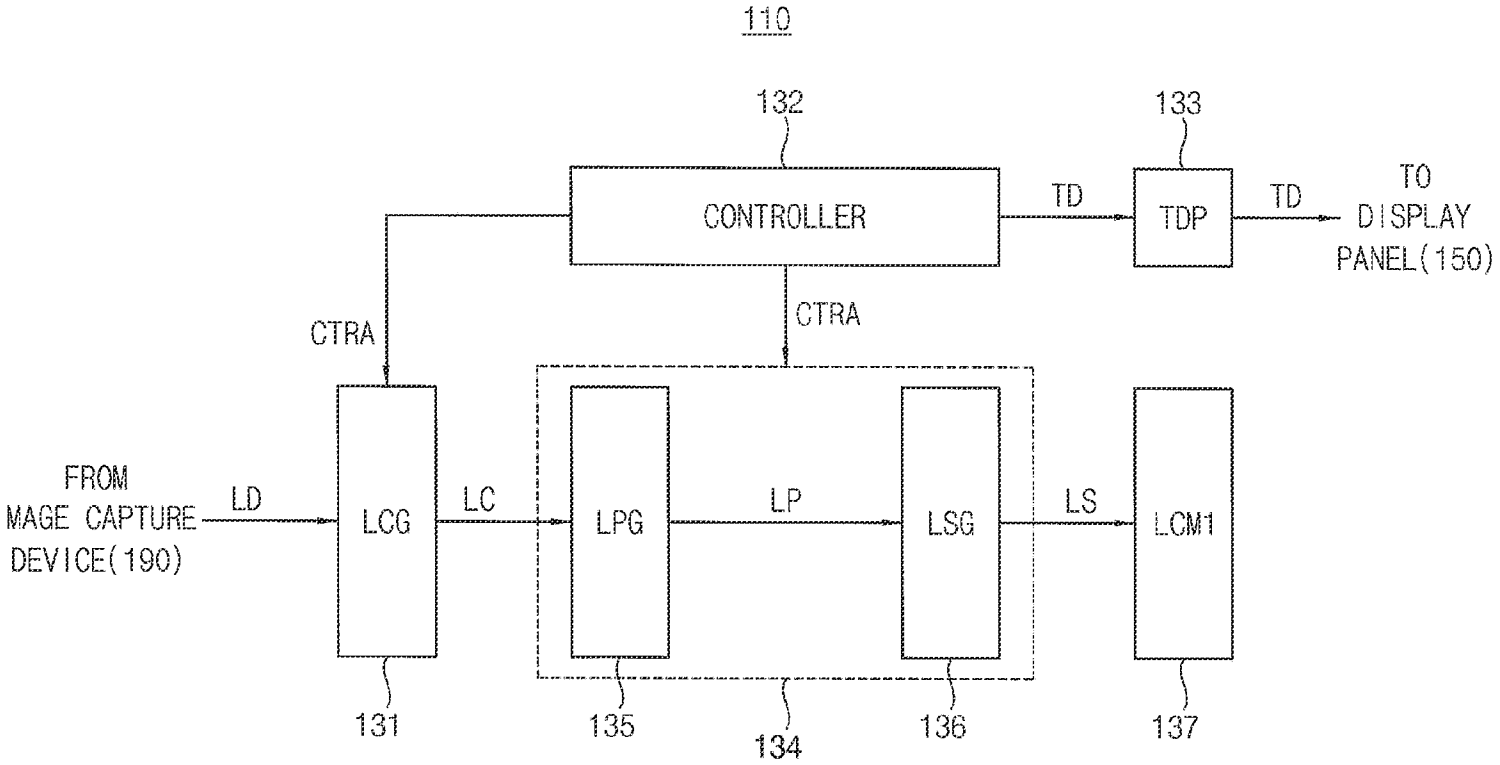
FIG. 3 is a block diagram further illustrating in one example the first luminance compensation circuit 110 of FIG. 2.

FIG. 3 is a block diagram illustrating in one example the first luminance compensation circuit 110 of FIG. 2.

Referring to FIGS. 2 and 3, the first luminance compensation circuit 110 may include a luminance compensation data generator (LCG) 131, a controller 132, a test image data provider (TDP) 133, a luminance compensation data processor 134 and a first luminance compensation memory (LCM1) 137. The luminance compensation data processor 134 includes an intra-plane data generator (LPG) 135 and an inter-plane stream data generator (LSG) 136.

The controller 132 may be used to generally control the operation and interoperation of the component 131, 133, 134, 135, 136 and 137 of the first luminance compensation circuit 110. The controller 132 may provide test image data TD to the test image data provider 133, wherein the test image data provider 133 temporarily stores the test image data TD and provides it to the display panel 150.

The luminance compensation data generator 131 receives luminance data LD from the image capture device 190 and receives a control signal CTRA from the controller 132. The luminance compensation data generator 131 may generate luminance compensation data LC in response to the control signal CTRA and based on the luminance data LD as well as reference luminance data. Here, the reference luminance data may be data corresponding to each of the test image data TD, and may indicate (or represent) ideal brightness values of the panel image displayed based on the test image data TD.

In some embodiments, the reference luminance data may be included in the control signal CTRA. In some embodiments, the luminance compensation data generator 131 may compare test luminance values included in the luminance data LD with reference luminance values included in the reference luminance data. The luminance compensation data generator 131 may generate luminance compensation data LC by performing negative compensation when the test luminance values are greater than the reference luminance values and performing positive compensation when the test luminance values are less than the reference luminance values.

In some embodiments, each of the luminance compensation data LC has a same resolution as the display panel 150 and may be data having a defined size (e.g., (W*H), where 'W' is a width and 'H' is a height of the display panel). That is, the size of the luminance compensation data LC may be 1920*1080 in a full HD display panel, 3840*2160 in a 4K UHD display panel and 7680*4320 in an 8K UHD display panel.

Figure 4:
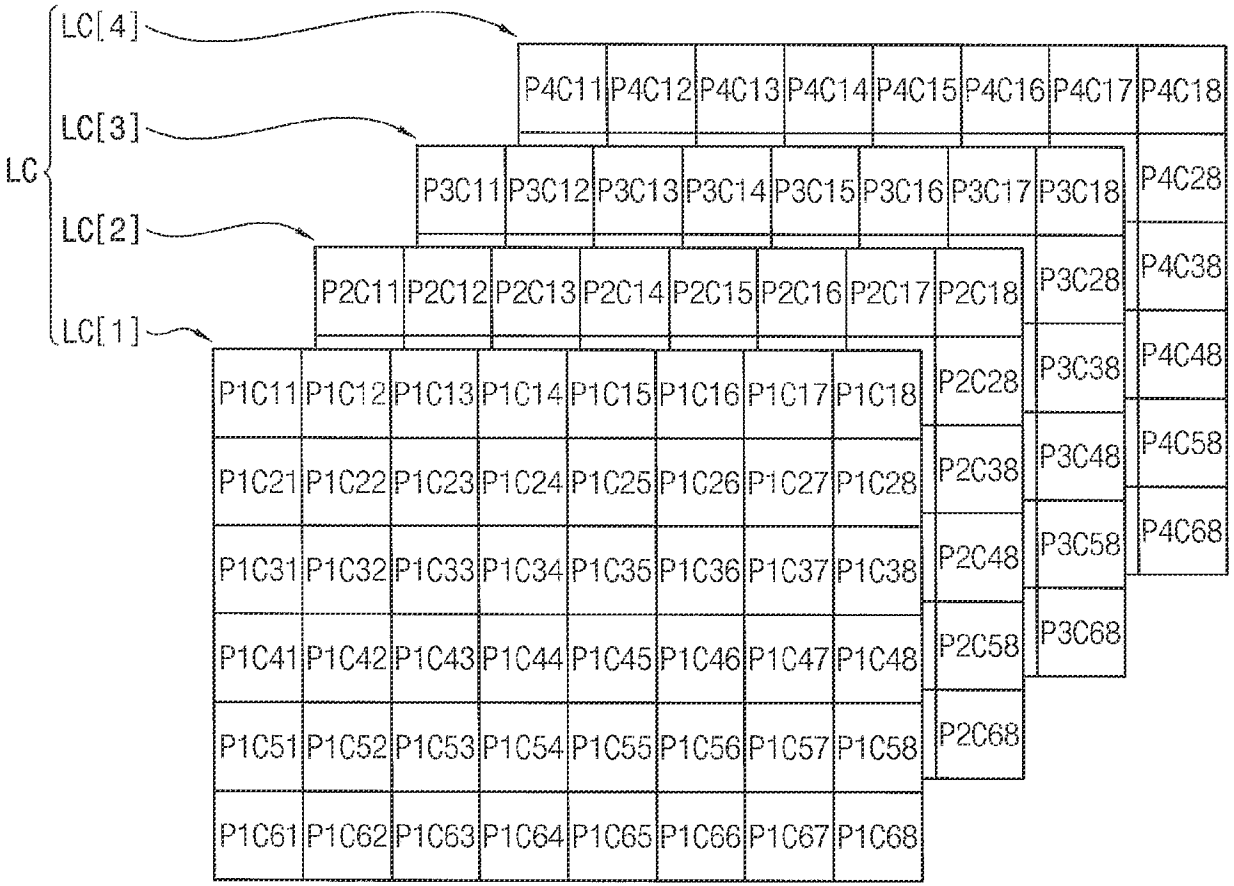
FIG. 4 is a conceptual diagram illustrating one example of luminance compensation data.

FIG. 4 is a conceptual diagram illustrating an example of luminance compensation data.

In FIG. 4, the luminance compensation data LC includes first to fourth luminance compensation data LC[1] to LC[4]. Each luminance compensation data may be 6*8 data having a height of 6 and a width of 8. However, this number and size of the luminance compensation data LC is merely an example. In some embodiments, the luminance compensation data LC may have a number and a size corresponding to the test image data TD.

Referring to FIG. 4, the first luminance compensation data LC[1] includes a plurality of data P1C11 to P1068, where the number '1' after the letter P representing each data indicates that the data corresponds to the first luminance compensation data among a plurality of luminance compensation data, and the number '11' after the letter C indicates that the data is disposed in a first row and a first column. In the illustrated example, the second luminance compensation data LC[2] includes a data P2C11 to P2C68, the third luminance compensation data LC[3] includes data P3C11 to P3C68, and the fourth luminance compensation data LC[4] includes of data P4C11 to P4C68. Hereinafter, various data generated based on the luminance compensation data LC will be described in the context of the luminance compensation data LC shown in FIG. 4.

Referring back to FIGS. 2 and 3, the intra-plane data generator 135 receives the luminance compensation data LC from the luminance compensation data generator 131, receives the control signal CTRA from the controller 132, and generates intra-plane data LP based on the luminance compensation data LC.

In some embodiments, the intra-plane data generator 135 may generate one of the intra-plane data LP based on one of the luminance compensation data LC. In some embodiments, the intra-plane data generator 135 may generate one of the intra-plane data LP based on data blocks generated by dividing one of the luminance compensation data LC into a predetermined size. It approach will be described in some additional detail hereafter.

Figure 5:
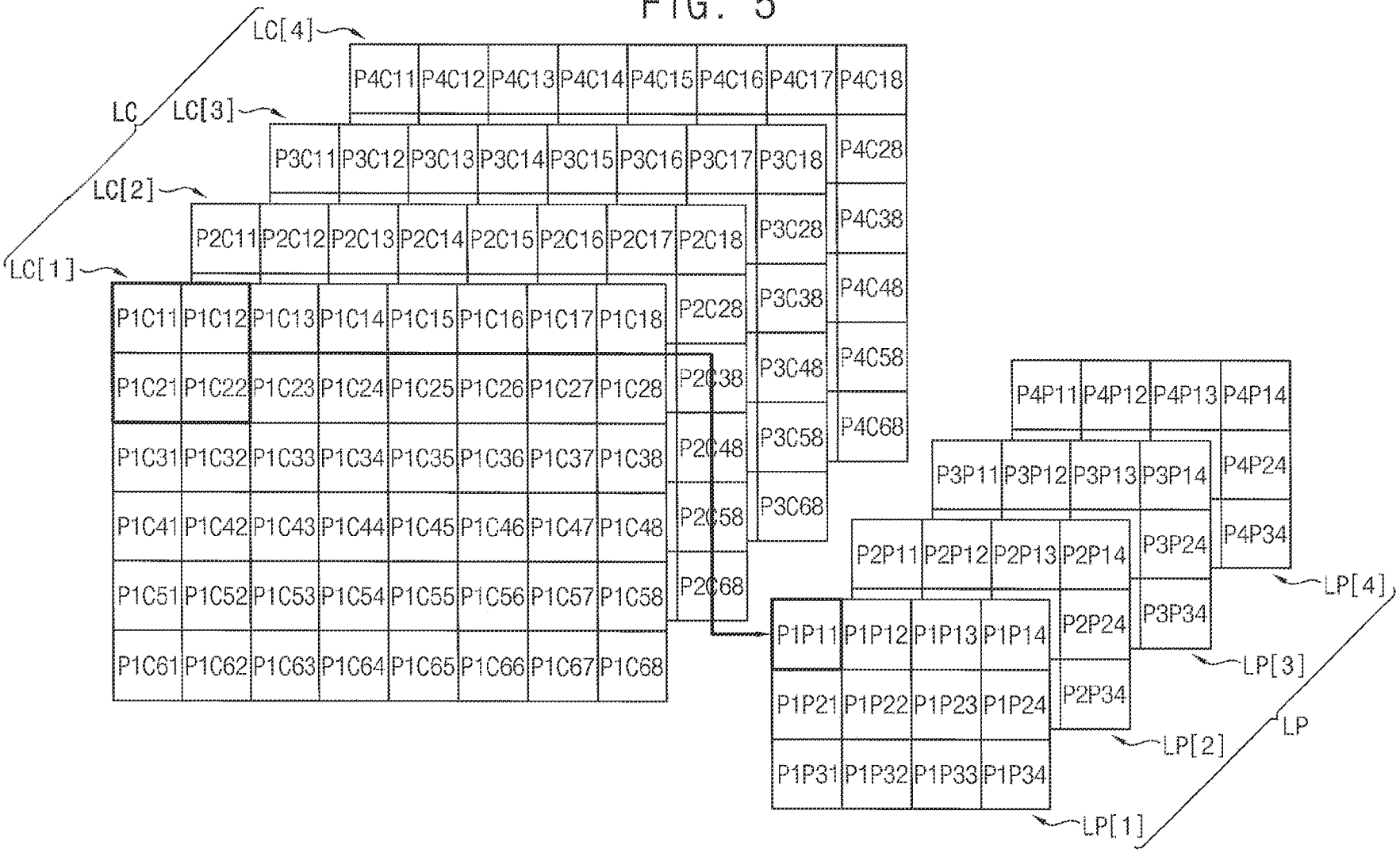
FIG. 5 is a conceptual diagram illustrating one example of intra-plane data.

FIG. 5 is a conceptual diagram further illustrating in one example the generation of the intra-plane data.

In FIG. 5, the luminance compensation data LC of FIG. 4 and corresponding intra-plane data LP are shown. That is, luminance compensation data LC including first to fourth luminance compensation data LC[1] to LC[4], and intra-plane data LP including corresponding first to fourth intra-plane data LP[1] to LP[4] are shown. In some embodiments, the number (or grouping) of the intra-plane data LP may be the same as the number of luminance compensation data LC. For example, the size of each intra-plane data may be 3*4 (e.g., having a height of 3 and a width of 4) in the illustrated example. However, the number and the size of the intra-plane data LP may vary by design.

Thus, referring to FIG. 5, the first intra-plane data LP[1] are generated based on the first luminance compensation data LC[1], the second intra-plane data LP[2] are generated based on the second luminance compensation data LC[2], the third intra-plane data LP[3] are generated based on the third luminance compensation data LC[3] and the fourth intra-plane data LP[4] are generated based on the fourth luminance compensation data LC[4]. That is, a plurality of first data blocks are generated by dividing the first luminance compensation data LC[1], wherein each one of the plurality of first data blocks has a first size. Information about the first size may be included in the control signal CTRA.

The first intra-plane data LP[1] are generated based on the first data blocks. For example, an intra-plane value P1P11 included in the first intra-plane data LP[1] may be generated based on luminance compensation values P1C11, P1C12, P1C21 and P1C22 included in one of the first data blocks generated by dividing the first luminance compensation data LC[1] into 2*2 sizes (groupings). An intra-plane value P1P12 included in the first intra-plane data LP[1] may be generated based on luminance compensation values P1C13, P1C14, P1C23 and P1C24 included in one of the first data blocks. Inter-plane values P1P13 to P1P33 included in the first intra-plane data LP[1] may be generated in a similar manner, and an intra-plane value P1P34 included in the first intra-plane data LP[1] may be generated based on luminance compensation values P1C57, P1C58, P1C67 and P1C68 included in one of the first data blocks. Furthermore, the second intra-plane data LP[2], the third intra-plane data LP[3] and the fourth intra-plane data LP[4] may also be generated in a similar manner to the first intra-plane data LP[1].

In some embodiments, an intra-plane value (e.g. P1P11) included in each of the intra-plane data may be generated as a representative value of luminance compensation values (e.g. P1C11, P1C12, P1C21 and P1C22) included in one of the first data blocks. For example, the representative value may be an average value of luminance compensation values included in the first data blocks, but the scope of the inventive concept is not limited thereto.

Referring back to FIGS. 2 and 3, the inter-plane stream data generator 136 receives the intra-plane data LP from the intra-plane data generator 135, receives the control signal CTRA from the controller 132, and generates inter-plane stream data LS based on the intra-plane data LP. In some embodiments, the inter-plane stream data generator 136 may generate inter-plane stream data LS based on the intra-plane data LP. That is, the inter-plane stream data generator 136 may generate one of the inter-plane stream data LS based on data blocks included in the intra-plane data LP and disposed at a same location within the intra-plane data LP. In some embodiments, the inter-plane stream data generator 136 may generate a first inter-plane stream data among the inter-plane stream data based on selected second data blocks among a plurality of second data blocks generated by dividing the intra-plane data into a predetermined size. The selected second data blocks may be included in different intra-plane data and may be disposed at a first location within the intra-plane data. Here, each of the second data blocks may have a second size.

Figure 6:
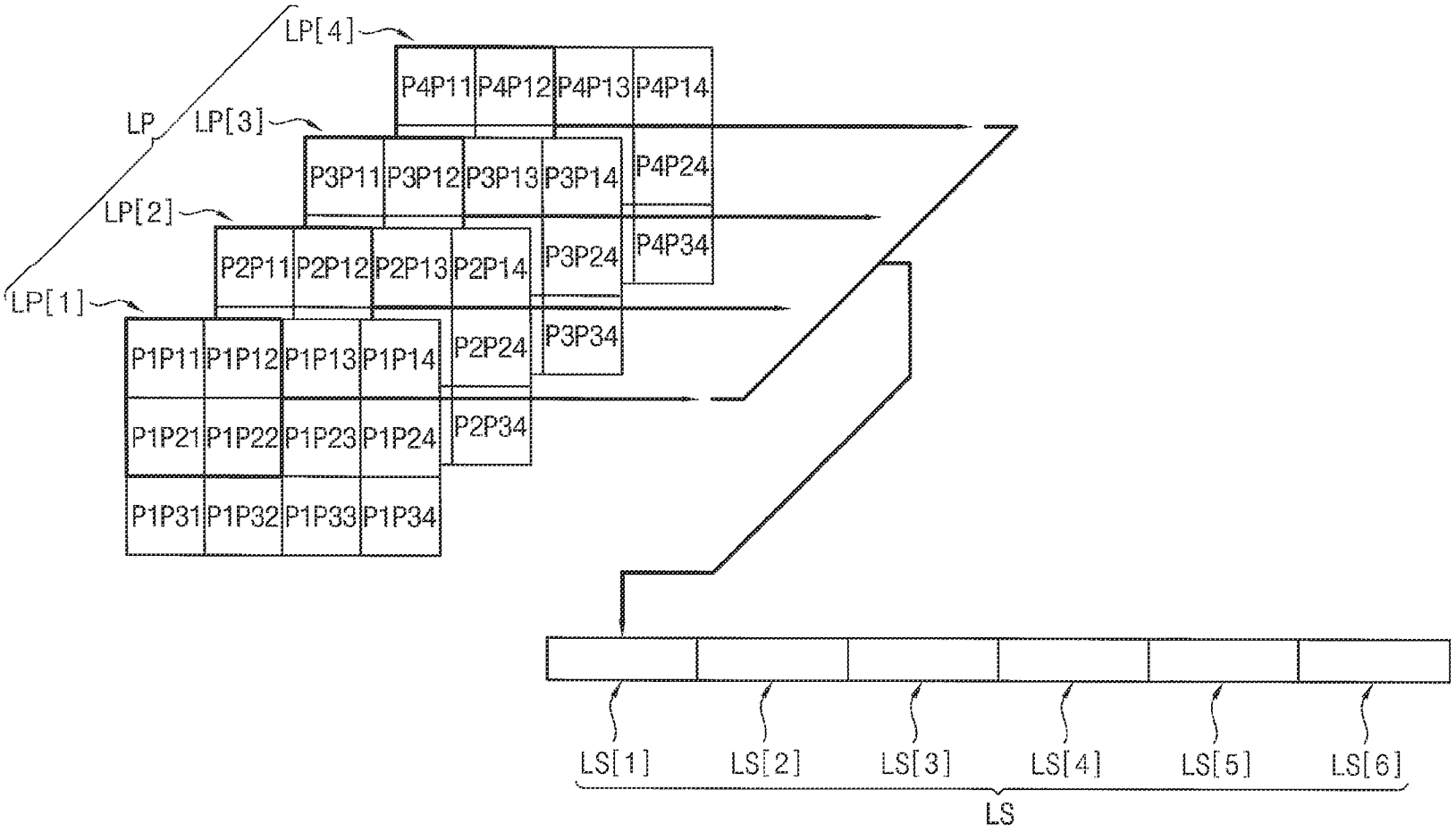
FIG. 6 is a conceptual diagram illustrating one example of inter-plane stream data.

FIG. 6 is a conceptual diagram illustrating in one example the inter-plane stream data.

In FIG. 6, intra-plane data LP and corresponding inter-plane stream data LS are shown. Here, the intra-plane data LP includes first to fourth intra-plane data LP[1] to LP[4], and the inter-plane stream data LS includes first to sixth inter-plane stream data LS[1] to LS[6]. The intra-plane data LP shown in FIG. 6 are the same as the intra-plane data LP illustrated in FIG. 5, but the number and size of the inter-plane stream data LS may vary by design.

Referring to FIG. 6, one of the inter-plane stream data, LS[1] to LS[6], among the inter-plane stream data LS may be generated based on second data blocks. Here, the second data blocks may be included in the first to fourth intra-plane data LP[1] to LP[4] and may be disposed at the same location within the first to fourth intra-plane data LP[1] to LP[4]. That is, a plurality of second data blocks may be generated by dividing the first to fourth intra-plane data LP[1] to LP[4]. Each of the second data blocks may have a second size, where information about the second size may be included in the control signal CTRA.

For example, a first inter-plane stream data LS[1] may be generated based on selected second data blocks PmP11, PmP12, PmP21 and PmP22 from among the plurality of second data blocks, where is a natural number greater than 0 and less than 5. The selected second data blocks may be included in different intra-plane data and disposed at a first location within the intra-plane data. In similar manner, a second inter-plane stream data LS[2] may be generated based on selected second data blocks PmP12, PmP13, PmP22 and PmP23, a third inter-plane stream data LS[3] may be generated based on selected second data blocks PmP13, PmP14, PmP23 and PmP24, and so on, for a fourth, fifth and sixth inter-plane stream data LS [4], LS [5] and LS [6] in the working example of FIG. 6.

The order in which each of the inter-plane stream data LS is generated may be related to a write order used to store, or a read order used to retrieve the inter-plane stream data LS from memory. Alternately or additionally, the order in which each of the inter-plane stream data LS is generated described may be related to an order in which the luminance compensation data is used during decoding, rearranging and/or interpolating of the inter-plane stream data LS. Alternately or additionally, the order in which the inter-plane stream data LS is generated may be related to the display scan method of a display device included in the second luminance compensation system 200, as will be described in some additional detail hereafter with reference to FIG. 8.

In some embodiments, inter-plane stream values included in each of the inter-plane stream data LS may be generated as a representative value of the selected second data blocks. For example, the representative value may be generated by applying an encoding algorithm to the selected data blocks. The encoding algorithm may be one of an advance encryption standard (AES) algorithm and a lightweight encryption algorithm (LEA), but the scope of the inventive concept is not limited thereto.

Referring back to FIGS. 2 and 3, the controller 132 may control the inter-plane stream data generator 136 and the first luminance compensation data memory 137 to sequentially store the inter-plane stream data LS to the first luminance compensation data memory 137.

Figure 7A:
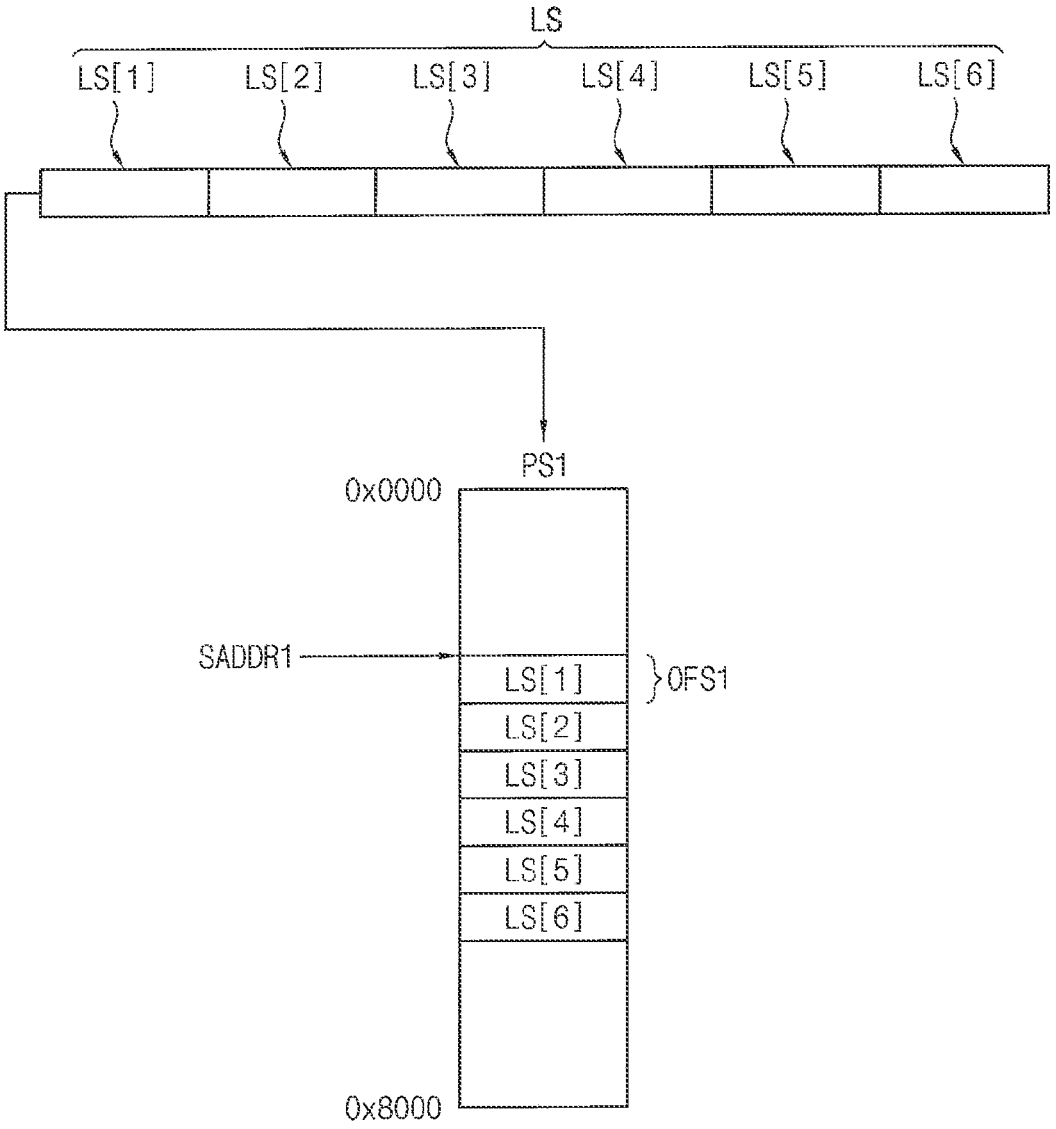
FIGS. 7A and 7B are respective conceptual diagrams illustrating methods of storing inter-plane stream data in embodiments of the inventive concept.
Figure 7B:
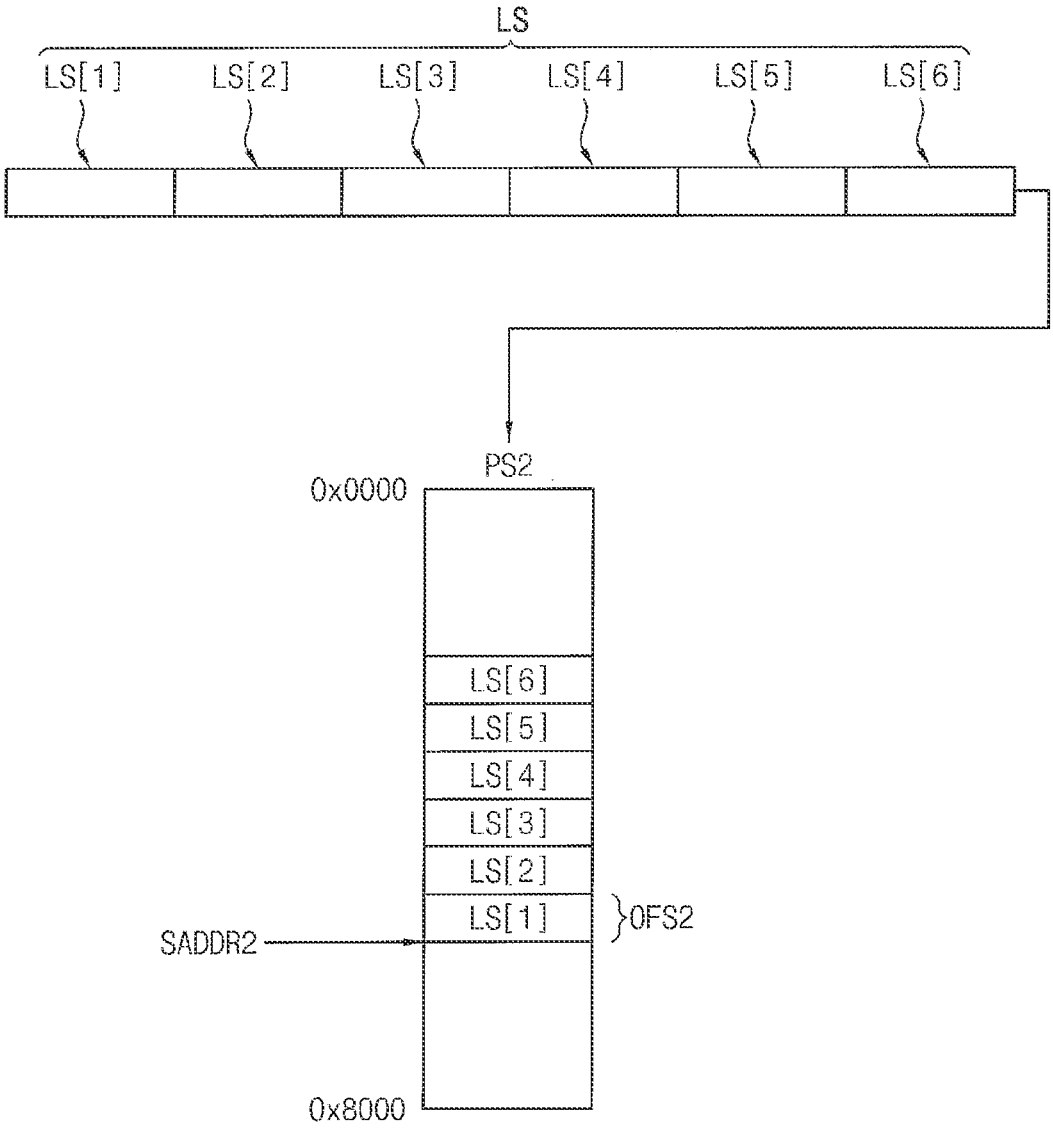

FIGS. 7A and 7B are respective conceptual diagrams illustrating example methods of storing the inter-plane stream data.

In FIGS. 7A and 7B, the inter-plane stream data LS and physical spaces PS1 and PS2 of the first luminance compensation data memory 137 are shown.

Here, it is assumed that the controller 132 stores the inter-plane stream data LS to the first luminance compensation data memory 137 according to an order in which the inter-plane stream data LS (e.g. LS[1]→LS[2]→ . . . →LS [6]) is generated.

Referring to FIG. 7A, the inter-plane stream data LS are sequentially stored in a direction from a first address to a second address of the first luminance compensation data memory 137. In some embodiments, the first address may be higher than the second address. In some embodiments, the controller 132 may generate information representing a start address SADDR1 and an offset OFS1, and store the information in a special function register included in the first luminance compensation data memory 137. The start address SADDR1 may be represent an address at which the plurality of inter-plane stream data starts to be stored in the first luminance compensation data memory 137, and the offset OFS1 may represent a size of each inter-plane stream data.

Referring to FIG. 7B, the inter-plane stream data LS are sequentially stored in a direction from a third address to a fourth address of the first luminance compensation data memory 137. In some embodiments, the third address may be lower than the fourth address. In some embodiments, the controller 132 may generate information representing a start address SADDR2 and an offset OFS2, and store the information in a special function register included in the first luminance compensation data memory 137. In this case, the offset OFS2 has the same size as the offset OFS1, but may have a different sign.

FIG. 8 is a block diagram illustrating a second luminance compensation system 200 according to embodiments of the inventive concept.

Referring to FIG. 8, the second luminance compensation system 200 generally includes a host processor 300 and a display device 210, wherein the display device 210 includes a display panel 230 and a display driver IC 250.

The second luminance compensation system 200 may be a display system that receives input image data IMG and generates output image data for displaying an image on the display panel 230.

The host processor 300 controls the overall operation of the second luminance compensation system 200. In some embodiments, the host processor 300 may be implemented as an application processor (AP), a baseband processor (BBP), a micro-processing unit (MPU) or the like.

The host processor 300 provides the input image data IMG, a clock signal CLK and a control signals CTRB required for operation of the display device 210. In some embodiments, the input image data IMG may include RGB pixel values and have a defined resolution (e.g., a particular W*H).

The control signals CTRB may include a command signal, a horizontal synchronization signal, a vertical synchronization signal and a data enable signal. In some embodiments, the input image data IMG and the control signals CTRB may be provided to the display driver 250 as one or more data packet(s). The command signal may include a signal for controlling image processing performed by the display driver 250, image information and display environment setting information.

In some embodiments, a signal generally controlling image processing may include a signal for controlling the second luminance compensation circuit (LCC2) 270 to compensate the input image data IMG during the generation of the output data. In some embodiments, the image information may be information about the input image data IMG input to the display driver 250 and may include a resolution of each of the input image data IMG. In some embodiments, the display environment setting information may include panel information, a luminance setting value, or the like.

The display driver 250 drives the display panel 230 based on the input image data IMG and in response to the control signals CTRB received from the host processor 300. In this regard, the display driver 250 converts the digital input image data IMG into corresponding analog signals, and drives the display panel 230 with the analog signals. The display driver 250 includes the second luminance compensation circuit 270. The second luminance compensation circuit 270 includes a second luminance compensation data memory (LCM2) 270.

Thus, the second luminance compensation circuit 270 may generate the output image data for displaying an image by compensating the input image data IMG using the luminance compensation data, and then provide the compensated output image data to the display panel 230.

The second luminance compensation data memory 270 may be used to store the luminance compensation data generated (e.g.,) by the first luminance compensation circuit 110 of FIGS. 2 and 3. That is, the luminance compensation data may be data that has been transformed into inter-plane stream data LS using (e.g.,) one of the methods illustrated in FIGS. 7A and 7B and stored in the first luminance compensation data memory 131.

In some embodiments, the first luminance compensation data memory 131 and the second luminance compensation data memory 270 may be the same. In this case, start addresses SADDR1 and SADDR2 and offsets OFS1 and OFS2 may be stored in a designated area of the first luminance compensation data memory 131.

In some embodiments, when the manufacturer of the display panel 230 and the manufacturer of the display device 210 are different, the first luminance compensation data memory 131 may be transferred from the manufacturer of the display panel 230 to the manufacturer of the display device 270. In this case, the manufacturer of the display device 270 may copy the contents of the first luminance compensation data memory 131 and store the contents in the second luminance compensation data memory 270.

The display panel 230 is a panel capable of displaying an image, and may include an LCD panel (Liquid Crystal Display Panel), an Electrophoretic Display Panel, an OLED panel (Organic Light Emitting Diode Panel), an LED panel (Light Emitting Diode Panel), an inorganic EL panel (Electro Luminescent Display Panel), a FED panel (Field Emission Display Panel), a SED panel (Surface-conduction Electro-emitter Display Panel), a PDP (Plasma Display Panel) and a CRT (Cathode Ray Tube) display panel.

The display system 200 may be implemented as a component part of a mobile phone having an image display function, a smart phone, a tablet personal computer, a personal digital assistant (PDA), a wearable electronic device or a portable multimedia player (PMP). In addition, the display system 200 may be implemented with various electronic devices such as a TV, a notebook computer, a desktop PC and a navigation device.

Figure 9:
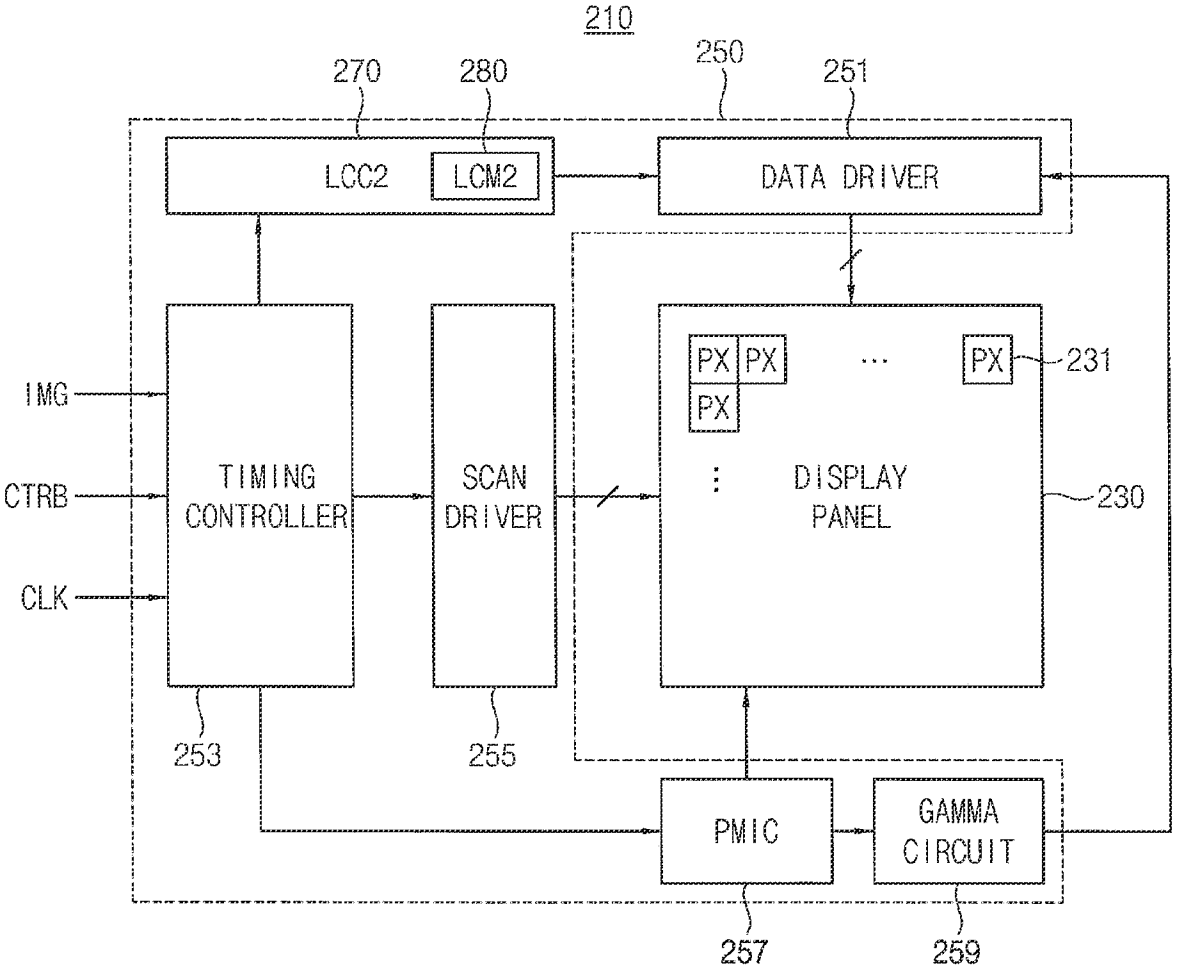
FIG. 9 is a block diagram further illustrating in one example the display device 210 of FIG. 8.

FIG. 9 is a block diagram further illustrating in one example the display device 210 of FIG. 8.

Referring to FIG. 9, the display device 210 includes a display panel 230 including a plurality of pixels rows 231 and a display driver 250 driving the display panel 230.

The display driver 250 includes a data driver 251, a scan driver 255, a timing controller 253, a power supply unit 257, a second luminance compensation circuit (LCC2) 270 and a gamma circuit 259.

The display panel 230 may be connected to the data driver 251 of the display driver 250 through data lines, and may be connected to the scan driver 255 of the display driver 250 through scan lines. The display panel 230 may include pixel rows 231. The display panel 230 may include pixels PX arranged in a matrix of rows and columns. One pixel row 231 refers to one row of pixels PX that may be connected to the same scan line.

In some embodiments, each pixel PX included in the display panel 230 may have various configurations according (e.g.,) to a driving method. For example, the driving method may be classified into analog driving or digital driving according to a method of expressing gray levels. The luminance compensation method according to embodiments of the inventive concepts may be applied to both analog and digital driving.

The data driver 251 may apply a data signal to the display panel 230 through the data lines, and the scan driver 255 may apply a scan signal to the display panel 230 through the scan lines. The timing controller 253 may control operations of the display device 210. The timing controller 253 may control operation of the display device 210 by providing predetermined control signals to the data driver 251 and the scan driver 255.

In some embodiments, the data driver 251, the scan driver 255 and the timing controller 253 may be implemented as a single integrated circuit (IC). In some embodiments, the data driver 251, the scan driver 255 and the timing controller 253 may be implemented with two or more ICs. At least a driving module in which the timing controller 253 and the data driver 251 are integrally formed may be referred to as a timing controller embedded data driver (TED).

The timing controller 253 receives a plurality of input image data IMG and control signals CTRB from a host device, e.g. the host processor 300 illustrated in FIG. 8. For example, the input image data IMG may include red image data R, green image data G and blue image data B. The input image data IMG may include white image data. The input image data IMG may include magenta image data, yellow image data and cyan image data.

The control signals CTRB may include a master clock signal and a data enable signal. In addition, the control signal CTRB may further include a vertical synchronization signal and a horizontal synchronization signal.

The power supply 257 may supply a power voltage and a ground voltage to the display panel 230. In some embodiments, the power voltage may correspond to a high power voltage and the ground voltage may correspond to a low power voltage. Also, the power supply 257 may supply a regulator voltage to the gamma circuit 259. The gamma circuit 259 may generate a plurality of gamma reference voltages based on the regulator voltage. For example, the regulator voltage may be a power voltage or a voltage generated by a separate regulator voltage based on the power voltage.

The second luminance compensation circuit 270 may be used to compensate the input image data IMG based on luminance compensation data generated according to a luminance compensation method consistent with an embodiment of the inventive concept. Thus, the second luminance compensation circuit 270 may generate compensated image data CIMG from the input image data IMG. The luminance compensation data may be stored in the second luminance compensation data memory 280.

In FIG. 9, the second luminance compensation circuit 270 is shown as being disposed between the data driver 251 and the timing controller 253, but the scope of the inventive concept is not limited thereto. In some embodiments, the second luminance compensation circuit 270 may be included in the timing controller 253 or may be disposed in front of the timing controller 253.

Figure 10:
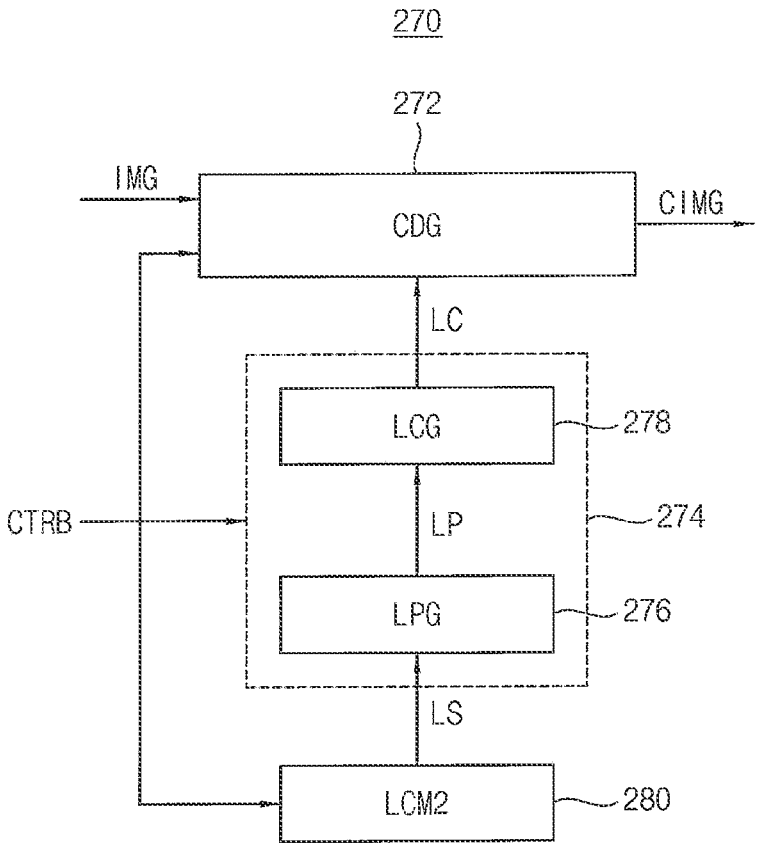
FIGS. 10 and 11 are respective block diagrams illustrating example of the second luminance compensation circuit of FIGS. 8 and 9.
Figure 11:
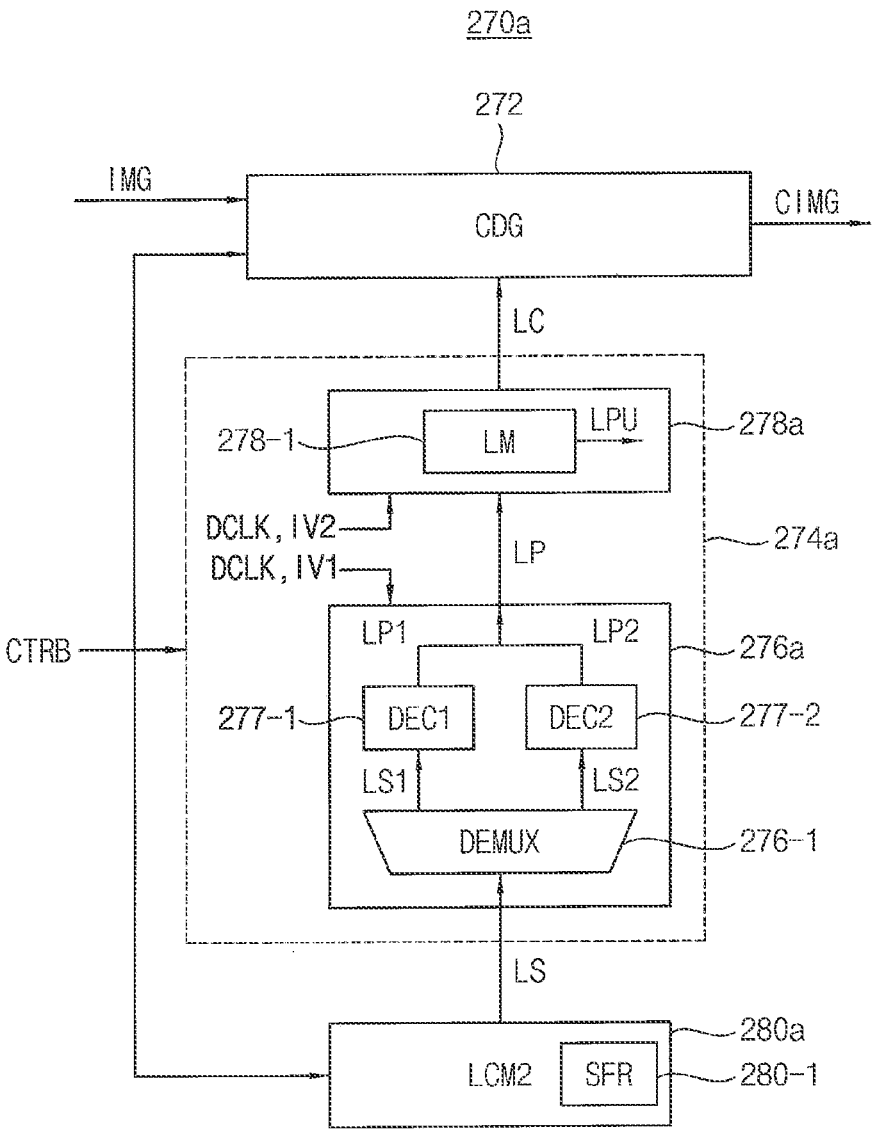

FIGS. 10 and 11 are respective block diagrams illustrating examples of a second luminance compensation circuit 270 and 270*a* of FIGS. 8 and 9.

Referring to FIGS. 8, 9 and 10, the second luminance compensation circuit 270 may include a compensation image data generator (CDG) 272, a second luminance compensation data provider 274, and a second luminance compensation data memory (LCM2) 280. The second luminance compensation data provider 274 includes an intra-plane data regenerator (LPG) 276 and a luminance compensation data regenerator (LCG) 278.

The second luminance compensation circuit 270 performs a function opposite to a function of the first luminance compensation circuit 110 of FIG. 3 based on the control signal CTRB received from the timing controller 253. That is, the second luminance compensation circuit 270 generates luminance compensation data LC based on the inter-plane stream data LS.

The host processor 300 controls the overall operation of components 272, 274, 276, 278 and 280 of the second luminance compensation circuit 270 through the timing controller 253. In some embodiments, the host processor 300 may control the components 272, 274, 276, 278 and 280 of the luminance compensation circuit 270 using the control signal CTRB.

The intra-plane data regenerator 276 sequentially reads inter-plane stream data LS from the second luminance compensation data memory 280. The intra-plane data regenerator 276 generates intra-plane data by generating data blocks based on the inter-plane stream data LS. The data blocks may be included in each of the intra-plane data and may be disposed at the same location within the intra-plane data. The intra-plane data regenerator 276 provides the intra-plane data LP to the luminance compensation data regenerator 278.

The luminance compensation data regenerator 278 receives intra-plane data LP from the intra-plane data regenerator 276. The luminance compensation data regenerator 278 generates luminance compensation data LC based on the intra-plane data LP. The compensation image data generator 272 generates output image data CIMG for displaying image by compensating the input image data IMG based on the luminance compensation data LC.

Referring to FIGS. 8, 9 and 11, the second luminance compensation circuit 270A includes a compensation image data generator 272, a second luminance compensation data provider 274A and a second luminance compensation data memory 280A. The second luminance compensation data provider 274A includes an intra-plane data regenerator 276A and a luminance compensation data regenerator 278A. The intra-plane data regenerator 276A includes a demultiplexer (DEMUX) 276-1 and a plurality of decoders. The number of decoders may be determined based on the number of the luminance compensation data LC corresponding to the gray levels described above with reference to FIG. 2.

In some embodiments, the number of decoders may be less than the number of the luminance compensation data LC. For example, as described above with reference to FIG. 4, when the luminance compensation data LC includes first to fourth luminance compensation data LC[1] to LC[4], the number of decodes may be only two, or half of the number of the luminance compensation data LC. Hereinafter, when the number of luminance compensation data LC is four, an embodiment is assumed in which the number of decoders is two. That is, it is assumed that the intra-plane data regenerator 276A is implemented using only the first decoder 277-1 and the second decoder 277-2 as decoders. However, the scope of the inventive concept is not limited thereto.

The luminance compensation data regenerator 278A may include a line memory 278-1, and the second luminance compensation data memory 280A may include a special function register (SFR) 280-1.

The second luminance compensation data memory 280A may be used to store inter-plane stream data LS. The special function register 280-1 stores the start addresses SADDR1 and SADDR2 and offsets OFS1 and OFS2 described above with reference to FIGS. 7A and 7B. The intra-plane data regenerator 276A sequentially reads the intra-plane stream data LS from the second luminance compensation data memory 280A. In some embodiments, when power is applied (e.g., turned-on) to the second luminance compensation system 200, the inter-plane stream data may be sequentially read based on the start addresses SADDR1 and SADDR2 and offsets OFS1 and OFS2 stored in the special function register 280-1 and in response to the control signal CTRB received from the timing controller 253.

The demultiplexer 276-1 may be used to distribute the read inter-plane stream data LS between the first decoder 277-1 and the second decoder 277-2. For example, assuming the inter-plane stream data LS is sequentially read from inter-plane stream data LS[1] to inter-plane stream data LS[6], the demultiplexer 276-1 may distribute first read inter-plane stream data LS[1] to the first decoder 277-1 and then distribute second read inter-plane stream data LS[2] to the second decoder 277-2, and so on, until the inter-plane stream data LS[3] to LS[6] have been distributed between the first decoder 277-2 and the second decoder 277-2.

In this manner, for example, the first decoder 277-1 and the second decoder 277-2 may be used to respectively decode the distributed inter-plane stream data LS[1] to LS[6] in order to generate corresponding intra-plane data LP[1] to LP[4].

The luminance compensation data regenerator 278A receives the intra-plane data LP from the first decoder 277-1 and the second decoder 277-2, and may rearrange and/or interpolates the intra-plane data LP in order to generate the luminance compensation data LC.

The luminance compensation data generator 278A communicates the luminance compensation data LC to the compensation image data generator 272. In some embodiments, the luminance compensation data generator 278A may temporarily store a portion of the intra-plane data LP1 and LP2 in the line memory 278-1.

Accordingly, the compensation image data generator 272 receives the input image data IMG from the timing controller 253 and receives the luminance compensation data LC from the luminance compensation data generator 278A. Hence, the compensation image data generator 272 may generate compensated image data CIMG by appropriately compensating the input image data IMG using the luminance compensation data LC. The compensation image data generator 269 may then communicate the compensated image data CIMG to the data driver 231.

Figure 12A:
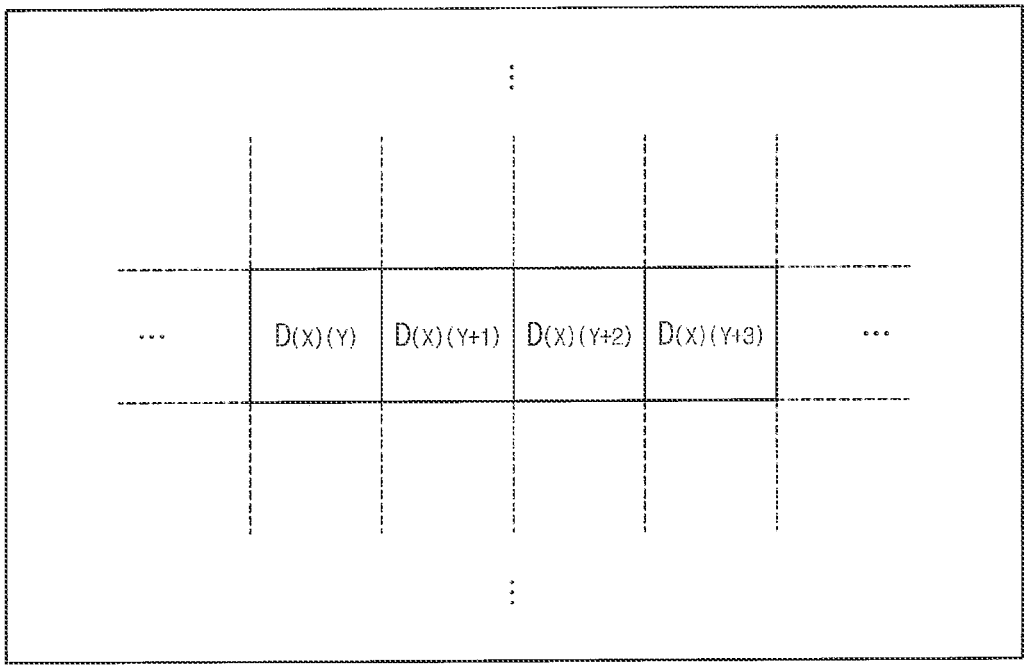
FIGS. 12A and 13A are conceptual diagrams illustrating operation of the first decoder and the second decoder of FIG. 11, and FIGS. 12B and 13B are related timing diagrams further illustrating the operation of the first decoder and the second decoder of FIG. 11.
Figure 12B:
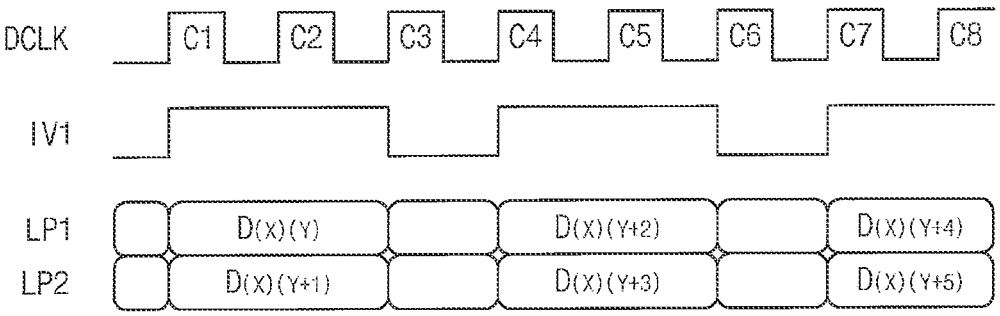
Figure 13A:
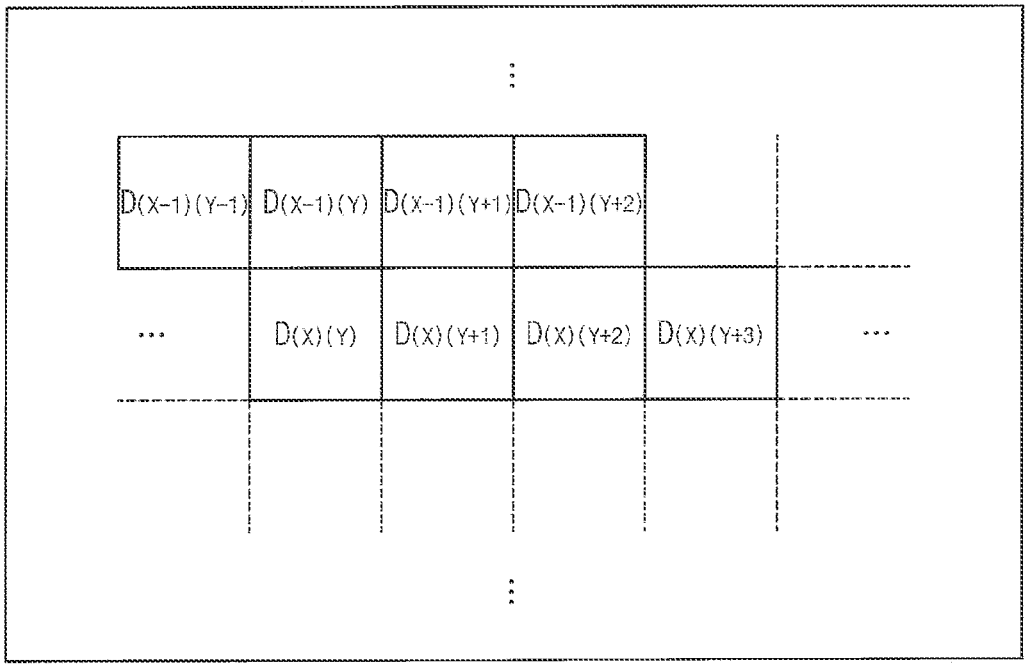
Figure 13B:
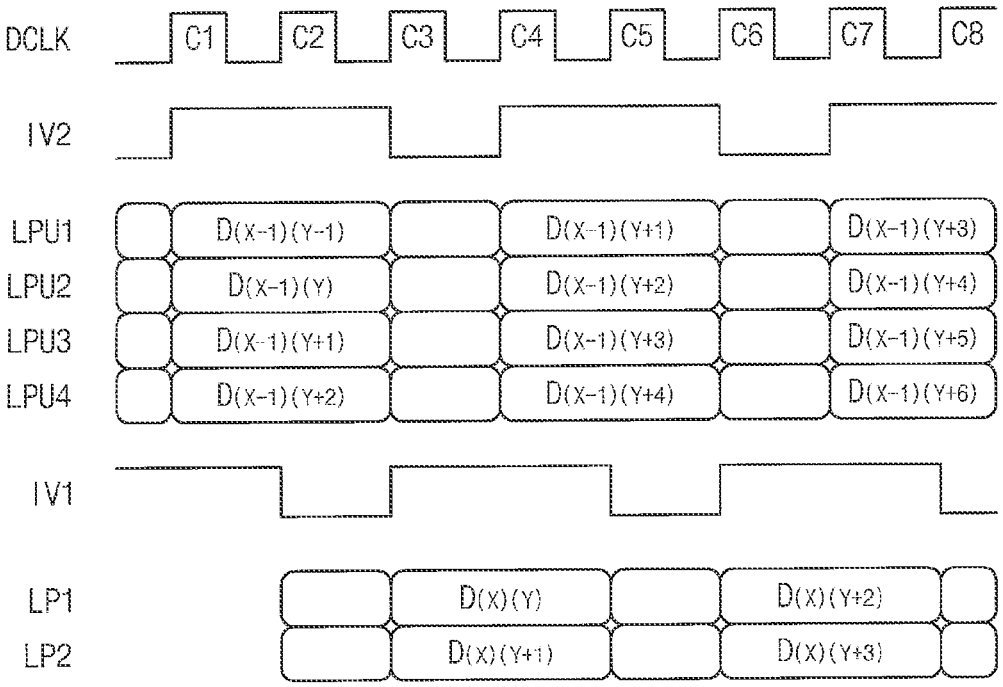

FIGS. 12A and 13A are conceptual diagrams illustrating examples of the operation of the first decoder 277-1 and the second decoder 277-2 of FIG. 11, and FIGS. 12B and 13B are respectively, related timing diagrams further illustrating the operation of the first decoder 277-1 and the second decoder 277-2 of FIG. 11.

In FIG. 12A, first exemplary input image data IMG are illustrated, and assumed to include pixels D(x)(y), D(x)(y+1), D(x)(y+2) and D(x)(y+3). In FIG. 12B, a clock signal DCLK, a validity signal IV1 and intra-plane data LP1 and LP2 are illustrated.

In order to compensate each of the pixels D(x)(y), D(x)(y+1), D(x)(y+2) and D(x)(y+3), luminance compensation data LC is required. Accordingly, luminance compensation data LC may be generated based on the intra-plane data LP. In FIG. 12B, an indication of pixels D(x)(y), D(x)(y+1), D(x)(y+2) and D(x)(y+3) included in the input image data IMG illustrated on each of the intra-plane data LP1 and LP2 represents intra-plane data output from the first decoder 277-1 and the second decoder 277-2 to compensate for each of the pixels D(x)(y), D(x)(y+1), D(x)(y+2) and D(x)(y+3).

Referring to FIGS. 11, 12A and 12B, the intra-plane data LP1 and LP2 corresponding to the pixels D(x)(y), D(x)(y+1), D(x)(y+2) and D(x)(y+3) may be output from each of the first decoder 277-1 and the second decoder 277-2 in time period(s) corresponding to clock signals C1 to C8. In some embodiments, intra-plane data corresponding to the pixels D(x)(y) and D(x)(y+1) may be output from each of the first decoder 277-1 and the second decoder 277-2 in a time period corresponding to the clock signals C1 and C2. Intra-plane data corresponding to the pixels D(x)(y+2) and D(x)(y+3) may be output from each of the first decoder 277-1 and the second decoder 277-2 in a time period corresponding to the clock signals C4 and C5. Intra-plane data corresponding to the pixels D(x)(y+4) and D(x)(y+5) may be output from each of the first decoder 277-1 and the second decoder 277-2 in a time period corresponding to the clock signals C7 and C8. In some embodiments, when the validity signal IV1 transitions to a logic low level in a time period corresponding to the clock signals C3 and C6, and outputs of the first decoder 277-1 and the second decoder 277-2 may be ignored.

In FIG. 13A, second, exemplary input image data IMG is illustrated and is assumed to include pixels D(x−1)(y−1), D(x−1)(y), D(x−1)(y+1), D(x−1)(y+2), D(x)(y), D(x)(y+1), D(x)(y+2) and D(x)(y+3). It is further assumed that pixels D(x−1)(y−1), D(x−1)(y), D(x−1)(y+1) and D(x−1)(y+2) from a preceding row are required to generate luminance compensation data LC corresponding to pixels D(x)(y) and D(x)(y+1). In some embodiments, the luminance compensation data LC corresponding to a plurality of pixels D(x−1)(y−1), D(x−1)(y), D(x−1)(y+1) and D(x−1)(y+2) may be temporarily stored in the line memory 278-1.

In FIG. 13B, a clock signal DCLK, validity signals IVC1 and IV2, line memory data LPU1, LPU2, LPU3 and LPU4 corresponding to a plurality of pixels D(x−1)(y−1), D(x−1)(y), D(x−1)(y+1), D(x−1)(y+2), D(x)(y), D(x)(y+1), D(x)(y+2) and D(x)(y+3) and intra-plane data LP1 and LP2 are illustrated.

Referring to FIGS. 11, 13A and 13B, line memory data LPU1, LPU2, LPU3 and LPU4 and intra-plane data LP1 and LP2 corresponding to pixels D(x−1)(y−1), D(x−1)(y), D(x−1)(y+1), D(x−1)(y+2), D(x)(y), D(x)(y+1), D(x)(y+2) and D(x)(y+3) may be output from each of the first decoder 277-1 and the second decoder 277-2 in a time period corresponding to clock signals C1 to C8. In some embodiments, intra-plane data corresponding to the pixels D(x−1)(y−1), D(x−1)(y), D(x−1)(y+1) and D(x−1)(y+2) may be output from the line memory 278-1 in a time period corresponding to the clock signals C1 and C2. Intra-plane data corresponding to the pixels D(x)(y) and D(x)(y+1) may be output from each of the first decoder 277-2 and the second decoder 277-2 in a time period corresponding to the clock signals C3 and C4. Intra-plane data corresponding to the pixels D(x−1)(y+1), D(x−1)(y+2), D(x−1)(y+3) and D(x−1)(y+4) may be output from the line memory 278-1 in a time period corresponding to the clock signals C4 and C5. Intra-plane data corresponding to the pixels D(x)(y+2) and D(x)(y+3) may be output from each of the first decoder 277-2 and the second decoder 277-2 in a time period corresponding to the clock signals C6 and C7. Intra-plane data corresponding to the pixels D(x−1)(y+3), D(x−1)(y+4), D(x−1)(y+5) and D(x−1)(y+6) may be output from the line memory 278-1 in a time period corresponding to the clock signals C7 and C8. In some embodiments, when the validity signal IV2 transitions to a logic low level in a time period corresponding to the clock signals C3 and C6, and outputs of the line memory 278-1 may be ignored. In some embodiments, when the validity signal IV1 transitions to a logic low level in a time period corresponding to the clock signals C2, C5 and C8, and outputs of the first decoder 277-1 and the second decoder 277-2 may be ignored.

Figure 14:
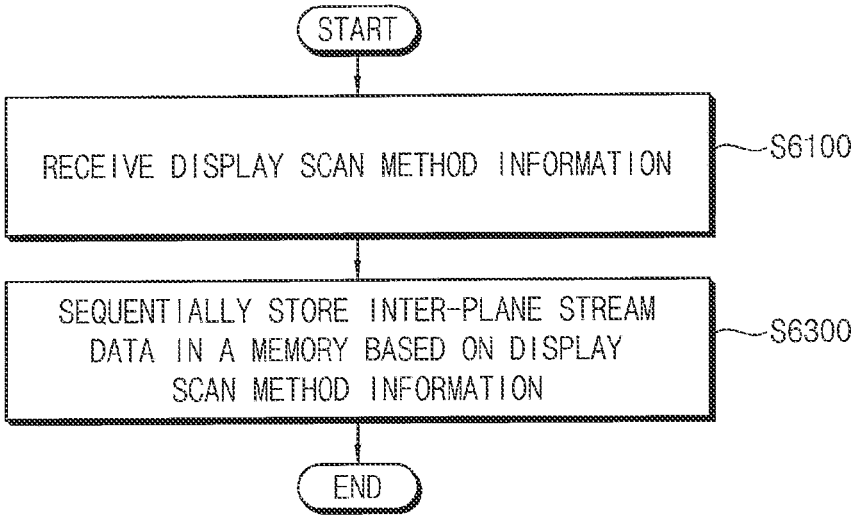
FIG. 14 is a flowchart summarizing in one example a method of sequentially storing inter-plane stream data in a memory in embodiments of the inventive concept.
Figure 15:
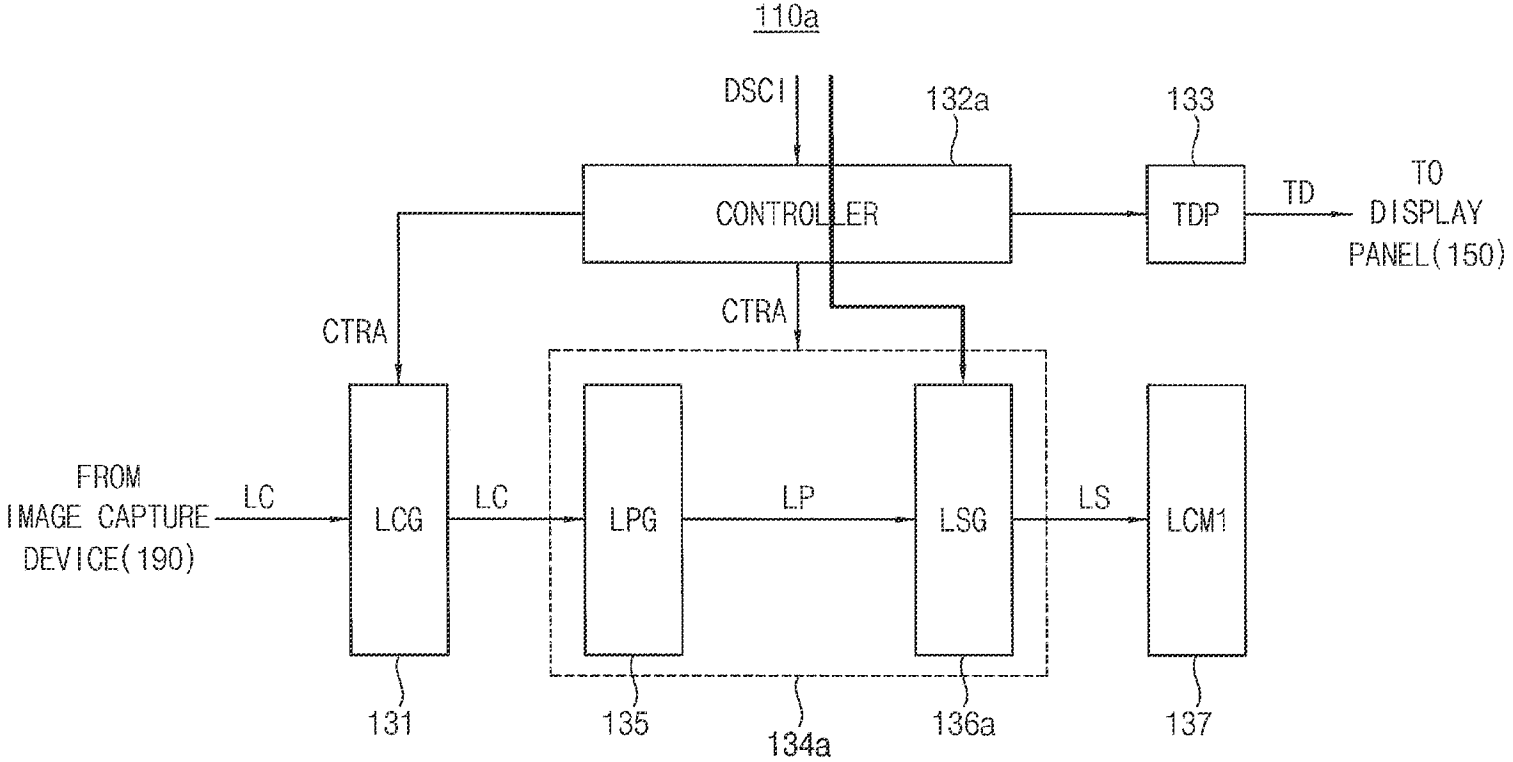
FIG. 15 is a block diagram illustrating in another example a first luminance compensation circuit according to embodiments of the inventive concept.

FIG. 14 is a flowchart summarizing an example of sequentially storing inter-plane stream data in a memory, and FIG. 15 is a block diagram illustrating in another example a first luminance compensation circuit 110*a*, analogous to the luminance compensation circuit 110 of FIG. 3, according to embodiments of the inventive concept.

Referring to FIG. 14, display scan method information indicating a scan method for a display device is received (S6100). As described above with reference to FIG. 6, for example, display scan method information may be related to (or defined by, wholly or in part) a generation order, a storing order, a reading order, a generation order for the luminance compensation data, a generation order for the inter-plane stream data, etc. Thereafter, the inter-plane stream data may be sequentially stored in a memory based on the display scan method information (S6300).

Referring collectively to FIGS. 2, 3, 14 and 15, the first luminance compensation circuit 110*a* of FIG. 15 may include a luminance compensation data generator (LCG) 131, a controller 132*a*, a test image data provider (TDP) 133, a luminance compensation data processor 134*a* and a first luminance compensation data memory (LCM1) 137. The luminance compensation data processor 134*a* may include an intra-plane data generator (LPG) 135 and an inter-plane stream data generator (LSG) 136*a* The first luminance compensation circuit 110*a* of FIG. 15 may perform similar function(s) to those previously described in relation to the first luminance compensation circuit 110 of FIG. 3, except that the controller 132*a* and the inter-plane stream data generator 136*a* further receive the display scan method information DSCI.

The controller 132*a* may be used to control the overall operation of the components 131, 133, 134*a*, 135, 136*a* and 137 of the first luminance compensation circuit 110*a* in FIG. 15. Here, the controller 132*a* further receives display scan method information DSCI from an external source. The display scan method information DSCI may include information identifying a method by which the compensated image data CIMG was generated by compensating the input image data IMG of FIG. 9. In some embodiments, the display scan method information DSCI may include information on one of a progressive type and an interlaced type as a raster scan scheme, but the scope of the inventive concept is not limited thereto. In some embodiments, the display scan method information DSCI may include information on a method of displaying a plurality of compensation image data CIMG on the display panel in various ways such as a continuous raster type, a diagonal scan type and a block scan type.

The controller 132*a* may control the inter-plane stream data generator 136*a* and the first luminance compensation data memory 137 to sequentially store inter-plane stream data LS to the first luminance compensation data memory LCM1. In some embodiments, the controller 132*a* may sequentially store the inter-plane stream data LS in the first luminance compensation data memory LCM1 based on the display scan method information DSCI.

Figure 16:
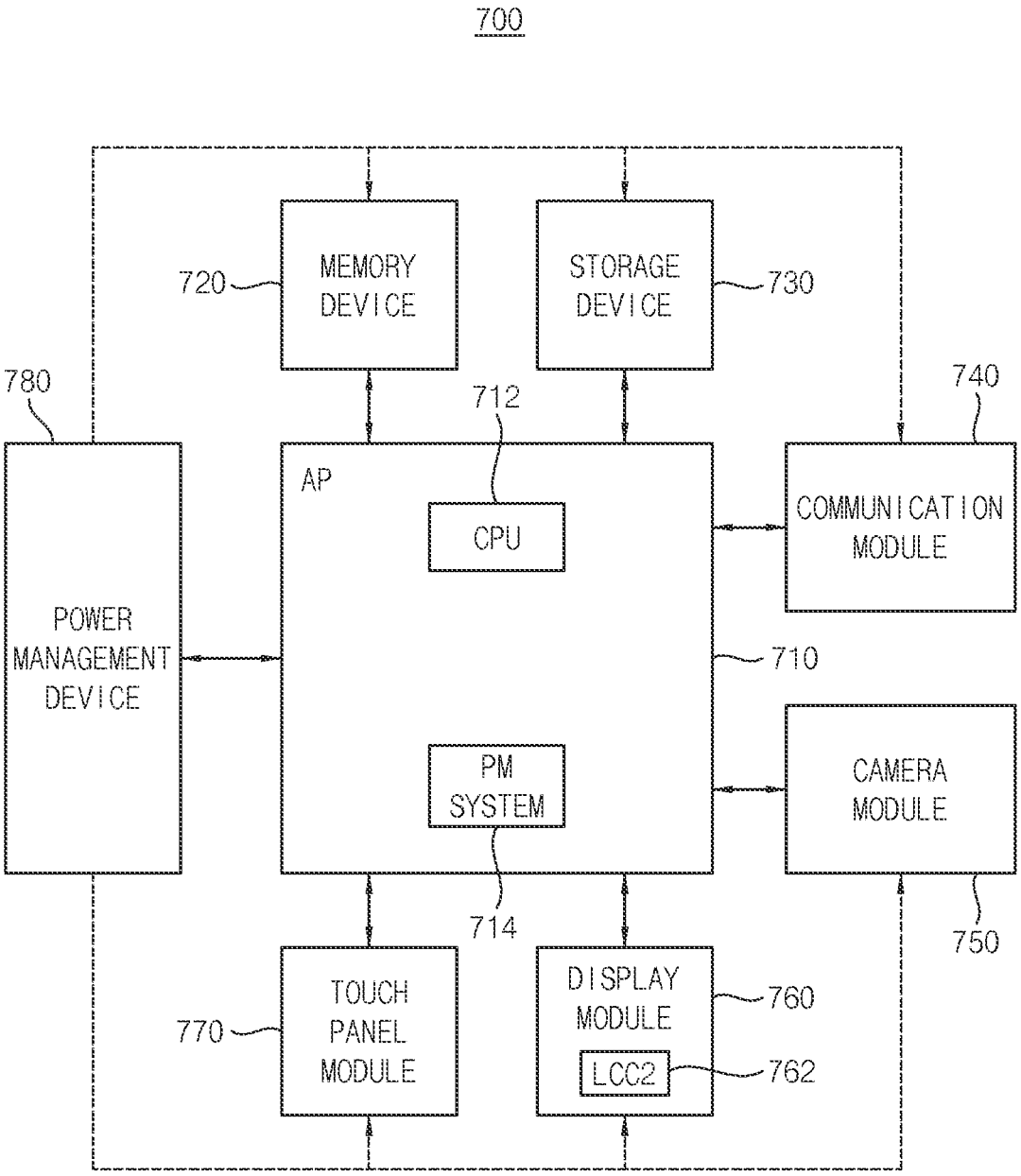
FIG. 16 is a block diagram illustrating a display mobile device including a second luminance compensation circuit according to embodiments of the inventive concept.

FIG. 16 is a block diagram illustrating a display mobile device including a second luminance compensation circuit according to embodiments of the inventive concept.

Referring to FIG. 16, the display mobile device 700 may include a system-on-chip 710 and functional modules 740, 750, 760 and 770. The display mobile device 700 may further include a memory device 720, a storage device 730 and a power management device 780.

The system-on-chip 710 may control the overall operation of the display mobile device 700 and its constituent components (e.g.,) the memory device 720, the storage device 730 and the functional modules 740, 750, 760 and 770. In some embodiments, the system-on-chip 710 may be an application processor (AP) provided in the display mobile device 700.

The system-on-chip 710 may include a central processing unit 712 and a power management system 714. The memory device 720 and the storage device 730 may store data necessary for operations of the display mobile device 700. For example, the memory device 720 may correspond to a volatile memory device such as a dynamic random access memory (DRAM) device, a static random access memory (SRAM) device, a mobile DRAM device, and the like, and the storage device 730 may correspond to a nonvolatile memory device such as an EPROM (erasable programmable read-only memory) device, electrically erasable programmable read-only memory (EEPROM) device, flash memory device, phase change random access memory (PRAM) device, resistance random access memory (RRAM) device, NFGM device, a polymer random access memory (PoRAM) device, a magnetic random access memory (MRAM) device, or a ferroelectric random access memory (FRAM) device. In some embodiments, the storage device 730 may further include a solid state drive (SSD), a hard disk drive (HDD), a CD-ROM, or the like.

The functional modules 740, 750, 760 and 770 may respectively perform various functions of the display mobile device 700. For example, the display mobile device 700 may include a communication module 740 for performing a communication function, e.g., a code division multiple access (CDMA) module, a long term evolution (LTE) module, a radio frequency (RF) module, An ultra wideband (UWB) module, a wireless local area network (WLAN) module, a worldwide interoperability for microwave access (WIMAX) module, etc., a camera module 750 for performing a camera function, a display module 760 for performing a display function, a touch panel module 770 for performing a touch input function, and the like. In some embodiments, the display mobile device 700 may further include a global positioning system (GPS) module, a microphone module, a speaker module, a gyroscope module, and the like. However, those skilled in the art will recognize that many different functional modules 740, 750, 760 and 770 may be included in the display mobile device 700.

The power management device 780 may provide driving voltages to the system-on-chip 710, the memory device 720, the storage device 730 and the functional modules 740, 750, 760 and 770, respectively.

According to embodiments of the inventive concept, the display module 760 may include a second luminance compensation circuit (LCC2) 762, such as the second luminance compensation circuits (e.g., 270 and 270A) described in relation to FIGS. 8, 9, 10, 11, 12A, 12B, 13A and 13B.

As described above, methods of luminance compensation, luminance compensation systems and display system performing luminance compensation may store luminance compensation data and data variously transformed from such in memory. That is, luminance compensation data may be transformed into intra-plane data, and the resulting intra-plane data may be transformed into inter-plane stream data that is sequentially stored in memory. Furthermore, methods of luminance compensation, luminance compensation systems and display systems according to embodiments of the inventive concept may sequentially read and decode the inter-plane stream data in an order of storing to read the luminance compensation data. In addition, by reducing the number of decoders required during the reading process, hardware cost and hardware complexity may be required in relation to the reading process.

The foregoing is illustrative of embodiments of the inventive concept. Although certain embodiments have been described herein, those skilled in the art will readily appreciate that many modifications are possible in the illustrated embodiments without materially departing from the novel teachings and advantages of the inventive concept. Accordingly, such modifications are included within the scope of the inventive concept, as defined by the following claims.

What is claimed is:

1. A method of luminance compensation, comprising:

generating luminance compensation data based on test image data, each of the test image data corresponding to one gray level, and each of the luminance compensation data including compensation values corresponding to the one gray level;

generating intra-plane data based on the luminance compensation data, one of the intra-plane data being generated based on one of the luminance compensation data;

generating inter-plane stream data based on the intra-plane data, a first inter-plane stream data from among the inter-plane stream data being generated based on data blocks included in different ones of the intra-plane data and disposed at a same location within the different ones of the intra-plane data; and sequentially storing the inter-plane stream data in a memory.

2. The method of claim 1, wherein the generating of the intra-plane data comprises:

generating a first intra-plane data from among the intra-plane data based on a plurality of first data blocks generated by dividing a first luminance compensation data among the luminance compensation data, and each of the plurality of first data blocks has a first size.

3. The method of claim 2, wherein one of the intra-plane data included in the first intra-plane data includes an average value of at least a portion of the plurality of first data blocks.

4. The method of claim 1, wherein the generating of the inter-plane stream data comprises:

generating the first inter-plane stream data based on selected data blocks from among the data blocks generated by dividing the intra-plane data, the selected data blocks are included in the different ones of the intra-plane data and disposed at the same location within the different ones of the intra-plane data, and each of the data blocks has a same size.

5. The method of claim 4, wherein the first inter-plane stream data is generated by encoding the selected data blocks.

6. The method of claim 5, wherein a start address of a location in the memory storing the inter-plane stream data and an offset representing a size of each of the inter-plane stream data are stored in a special function register included in the memory.

7. The method of claim 1, wherein the inter-plane stream data are sequentially stored in a direction from a first address to a second address in the memory.

8. The method of claim 1, wherein the sequentially storing of the inter-plane stream data in the memory comprises:

receiving display scan method information indicating a scan method for a display device; and sequentially storing the inter-plane stream data in the memory based on the display scan method information.

9. The method of claim 8, wherein the display scan method information includes one of a progressive type and an interlaced type.

10. The method of claim 1, further comprising:

sequentially reading the inter-plane stream data from the memory;

generating second intra-plane data by generating the data blocks based on the read inter-plane stream data, wherein the data blocks are included in each of the second intra-plane data and are disposed at a same location within the second intra-plane data;

generating second luminance compensation data based on the second intra-plane data; and generating output image data for displaying an image by compensating input image data based on the second luminance compensation data.

11. A luminance compensation system comprising:

a circuit configured to provide test image data to a display panel, wherein each of the test image data correspond to one gray level;

an image capture device configured to generate luminance data by capturing a panel image displayed on the display panel in response to test image data; and a luminance compensation circuit configured to generate luminance compensation data based on the luminance data, wherein each of the luminance compensation data includes compensation values corresponding to the one gray level, generate intra-plane data based on the luminance compensation data, generate a first inter-plane stream data, from among a plurality of inter-plane stream data, based on data blocks included in different ones of the intra-plane data and disposed at a same location within each of the different ones of the intra-plane data, and sequentially store the inter-plane stream data in a memory.

12. The luminance compensation system of claim 11, wherein the luminance compensation circuit is further configured to generate a plurality of first data blocks by dividing a first luminance compensation data from among the luminance compensation data into a first size, and generate a first intra-plane data from among the intra-plane data based on the plurality of first data blocks.

13. The luminance compensation system of claim 11, wherein the luminance compensation circuit is further configured to generate the data blocks by dividing the intra-plane data into a same size, and generate the first inter-plane stream data based on the data blocks included in the different ones of the intra-plane data and disposed at the same location among the data blocks.

14. The luminance compensation system of claim 11, wherein the luminance compensation circuit is further configured to sequentially store the inter-plane stream data in a direction from a lower address to a higher address of the memory.

15. The luminance compensation system of claim 14, wherein the memory includes a special function register, and the luminance compensation circuit is further configured to store information indicating a start address of the memory for the inter-plane stream data and an offset indicating a size of each inter-plane stream data in the special function register.

16. A display system comprising:

a display device including a luminance compensation circuit; and a host processor configured to control the display device, wherein the luminance compensation circuit comprises a luminance compensation data memory configured to store inter-plane stream data, an intra-plane data generator configured to sequentially read the inter-plane stream data and generate data blocks based on the inter-plane stream data to generate a plurality of intra-plane data, wherein the data blocks are included in each of different ones of the plurality of intra-plane data and are disposed at a same location within each of the different ones of the plurality intra-plane data, a luminance compensation data generator configured to generate luminance compensation data based on the plurality of intra-plane data, and a luminance compensation image data generator configured to generate output image data by compensating input image data based on the luminance compensation data.

17. The display system of claim 16, wherein the intra-plane data generator includes a de-multiplexer and a plurality of decoders, and a number of the plurality of decoders is half of a number of the luminance compensation data.

18. The display system of claim 17, wherein the de-multiplexer distributes the inter-plane stream data between the plurality of decoders.

19. The display system of claim 18, wherein the plurality of decoders respectively decode the inter-plane stream data distributed by the de-multiplexer to generate the intra-plane data.

20. The display system of claim 16, wherein the luminance compensation data memory includes a special function register that stores a start address of the luminance compensation data memory for the inter-plane stream data and an offset indicating a size of each of the inter-plane stream data.

* * * * *